US010858073B2

(12) United States Patent
Wilkes et al.

(10) Patent No.: US 10,858,073 B2
(45) Date of Patent: Dec. 8, 2020

(54) SECURITY BULWARK, PERIMETER PROTECTION SYSTEM AND METHOD OF PROTECTING A PERIMETER

(71) Applicant: Gray Page Marine Systems Limited, Farmoor (GB)

(72) Inventors: James Edward Wilkes, Oxford (GB); William Schofield, Preston (GB)

(73) Assignee: Gray Page Marine Systems Limited, Farmoor (GB)

( * ) Notice: Subject to any disclaimer, the term of this patent is extended or adjusted under 35 U.S.C. 154(b) by 0 days.

(21) Appl. No.: 15/999,621

(22) PCT Filed: Feb. 17, 2017

(86) PCT No.: PCT/EP2017/053716
§ 371 (c)(1),
(2) Date: Aug. 20, 2018

(87) PCT Pub. No.: WO2017/055641
PCT Pub. Date: Apr. 6, 2017

(65) Prior Publication Data

US 2019/0118909 A1 Apr. 25, 2019

(30) Foreign Application Priority Data

Feb. 19, 2016 (GB) ..... 1602940.7

(51) Int. Cl.
*B63B 17/04* (2006.01)
*B63G 13/00* (2006.01)
(Continued)

(52) U.S. Cl.
CPC ..... *B63B 17/04* (2013.01); *B63G 13/00* (2013.01); *F41H 11/05* (2013.01); *F41H 11/08* (2013.01); *B63B 2017/045* (2013.01)

(58) Field of Classification Search
CPC . F41H 11/08; B63B 2017/045; E04H 17/003; B63G 13/00
See application file for complete search history.

(56) References Cited

U.S. PATENT DOCUMENTS 6,443,088 B1 9/2002 Putman et al.
2011/0031653 A1 2/2011 Hebert
(Continued)

FOREIGN PATENT DOCUMENTS

AT 507881 A1 8/2010
CN 201350963 Y 11/2009
(Continued)

OTHER PUBLICATIONS

International Search Report and Written Opinion for PCT/EP2017/053716: dated Apr. 5, 2017.
(Continued)

*Primary Examiner* — Andrew Polay
(74) *Attorney, Agent, or Firm* — Banner & Witcoff, Ltd.

(57) ABSTRACT

In one aspect, the present invention provides a security bulwark for mounting outside a perimeter railing of a vessel or marine installation. The bulwark has a front face comprising a projecting mound. The mound has an underside which provides the bulwark with an overhang. The mound is also convex in a direction of the breadth of the bulwark. The invention also provides a perimeter protection system comprising a plurality of such security bulwarks arranged side-by-side and adjacent to each other. Finally, the invention further provides a method of protecting a perimeter of a vessel or marine installation. The method comprises positioning a plurality of security bulwarks side-by-side and adjacent to each other along a perimeter railing of a vessel or marine installation, attaching some of the plurality of security bulwarks to the railing, and connecting remaining ones of the plurality of security bulwarks which are not
(Continued)

attached to the railing to ones of the plurality of security bulwarks which are attached to the railing. Thus even if a security bulwark cannot be mounted directly to the perimeter railing, for example because of a gap in the railing or an obstruction in the way of the railing, the bulwark can still be positioned in the same location outside the railing and securely mounted in that location by being connected to an adjacent security bulwark which can be mounted to the perimeter railing.

20 Claims, 32 Drawing Sheets

(51) Int. Cl.
*F41H 11/08* (2006.01)
*F41H 11/05* (2006.01)

(56) References Cited

U.S. PATENT DOCUMENTS

| | | | | |
|---|---|---|---|---|
| 2017/0021899 | A1* | 1/2017 | McGarian | B63B 17/04 |
| 2017/0369129 | A1* | 12/2017 | McGarian | B63B 17/04 |

FOREIGN PATENT DOCUMENTS

| | | | |
|---|---|---|---|
| CN | 201357935 | Y | 12/2009 |
| CN | 201367101 | Y | 12/2009 |
| CN | 201472648 | U | 5/2010 |
| CN | 201626546 | U | 11/2010 |
| CN | 202935562 | U | 5/2013 |
| CN | 204142102 | U | 2/2015 |
| GB | 1341017 | A | 12/1973 |
| GB | 2496757 | A | 5/2013 |
| GB | 2524012 | A | 9/2015 |
| GB | 2528859 | A | 11/2015 |
| GB | 2528859 | A | 2/2016 |
| JP | 2001191983 | A | 7/2001 |
| KR | 20120020789 | A | 3/2012 |
| KR | 20130053325 | A | 5/2013 |
| KR | 101271127 | B1 | 6/2013 |
| KR | 20130005714 | U | 10/2013 |
| WO | 2011/009172 | A1 | 1/2011 |
| WO | 2014/182278 | A1 | 11/2014 |
| WO | 2015/136244 | A1 | 9/2015 |
| WO | 2015/181049 | A1 | 12/2015 |
| WO | 2016/156823 | A1 | 10/2016 |

OTHER PUBLICATIONS

Mar. 7, 2016—GB Search Report—GB 2531232.
Apr. 6, 2017—EP Search Report—EP 3168127.
Jun. 7, 2017—SG Search Report—SG 10201701305U.

* cited by examiner

SECURITY BULWARK, PERIMETER PROTECTION SYSTEM AND METHOD OF PROTECTING A PERIMETER

CROSS-REFERENCE TO RELATED APPLICATIONS

This application claims the benefit of and priority to PCT/EP2017/053716, filed Feb. 17, 2017, which is an International Application of and claims priority to GB Patent Application No. 1602940.7 entitled "SECURITY BULWARK, PERIMETER PROTECTION SYSTEM AND METHOD OF PROTECTING A PERIMETER," filed, Feb. 19, 2016, both of which are expressly incorporated herein by reference in their entirety for any and all non-limiting purposes.

The present invention concerns a security bulwark for protecting the perimeter of vessels, such as merchant and naval ships, and marine installations, such as oil rigs and other marine platforms, against unauthorized potential boarders, such as pirates, stowaways and activists. The present invention also concerns a perimeter protection system for a vessel or marine installation, and a method of protecting a perimeter of a vessel or marine installation.

With increased criminality at sea, there has been a corresponding increase in the need for sea-going vessels and marine installations to be protected against such unauthorized potential boarders. The unauthorized potential boarders may approach a ship or platform, for example, in one or more smaller, high-speed boats equipped with a variety of ladders, climbing poles, grappling hooks and ropes. They may bring such a boat alongside the larger ship or platform, raise a ladder or climbing pole from the boat up the side of the larger ship or platform and attempt to board it by climbing the ladder or pole to gain access to a deck of the ship or platform. They may also attempt to throw a grappling hook attached to a rope on to the deck in order to catch hold of an item fixed to the deck, thereby allowing them to scale the rope. This has led to the development of a number of different types of known security bulwark for protecting the perimeter of vessels and marine installations by aiming to thwart such unauthorized potential boarders. These known security bulwarks are typically mounted over a perimeter railing running along the edge of a deck of the vessel or marine installation. Examples of these known types of security bulwark are described in JP 2001 191983 A, GB 2 496 757 A, CN 2014 72648 U, CN 2013 50963 Y, CN 2013 57935 Y and CN 2013 67101 Y.

In general, these known types of security bulwarks are mounted over the perimeter railing side-by-side adjacent to each other to create a perimeter protection system for the vessel or marine installation, the system comprising a plurality of such security bulwarks. However, these known types of security bulwark have several disadvantages, as follows.

Firstly, some of them have been found not to be robust enough to withstand weather and high seas and actions by crew members during normal operations on board the vessel or marine installation, without being damaged. This reduces their effectiveness in thwarting unauthorized potential boarders from a vessel or marine installation on which they have been installed. For example, during normal operations, crew members often pass ropes or chains over the side of a vessel or marine installation. Without any security bulwarks installed on the vessel or marine installation, these ropes or chains are usually passed from the deck of the vessel or marine installation under or through the perimeter railing at the edge of the deck. However, with known types of security bulwarks installed along the perimeter railing, the crew members find that these bulwarks obstruct the passage of the ropes or chains under or through the railing, so instead pass the ropes or chains from the deck over the top of the security bulwarks mounted over the railing. These ropes or chains sometimes carry heavy objects on their ends for suspension over the side of the vessel or marine installation, such as fenders, which may typically weigh 4 or 5 tonnes each. If a rope or chain carrying such a fender is passed over a security bulwark mounted over a perimeter railing, the bulwark may tend to buckle or deform under such a weight. The weight of the object may also damage or distort the perimeter railing under the bulwark. Furthermore, considering that one cubic metre of seawater weighs about one tonne, simple impacts from waves in high seas can also buckle and deform known types of security bulwark.

Some known types of security bulwark have also been found to be difficult and slow to install on a vessel or marine installation by mounting them over the perimeter railing because there are often one or more types of obstruction in the way of the railing which can impede installation of the bulwarks. These obstructions include support stays for the railing located on an inboard side of the railing. Other obstructions include ones which the perimeter railing has been constructed around, such as fairleads for ropes, and those which are located close to and inboard of the railing on the deck of the vessel or marine installation, such as accommodation ladders, cleats and bitts. Moreover, the perimeter railing may often also have one or more gaps in it which are spanned by freely hanging chains. Such gaps and obstructions can impede or prevent the correct installation of a known type of security bulwark at several locations along the entire length of the perimeter railing, or can require laborious and time-consuming modification of the security bulwark during installation to avoid the obstructions, which can therefore also reduce the effectiveness of the bulwark in thwarting unauthorized potential boarders trying to gain access to the vessel or marine installation on which they have been installed.

Finally, even if it is correctly installed, a known type of security bulwark may still present an even surface to an unauthorized potential boarder, against which the boarder may attempt to lean a ladder or climbing pole.

The present invention aims to address these and other problems with the known types of security bulwark. It also aims to provide an improved type of security bulwark, an improved perimeter protection system for a vessel or marine installation, and an improved method of protecting a perimeter of a vessel or marine installation.

Accordingly, in a first aspect, the present invention provides a security bulwark for mounting outside a perimeter railing of a vessel or marine installation, the bulwark having a front face comprising a projecting mound, wherein the mound has an underside providing the bulwark with an overhang and the mound is convex in a direction of the breadth of the bulwark. By outside a perimeter railing of the vessel or marine installation is meant on a side of the perimeter railing which faces out to sea, in contrast to inside the perimeter railing facing in towards a deck of the vessel or marine installation. By a front face of the security bulwark is therefore meant a face of the security bulwark which, if the security bulwark is mounted outside a perimeter railing, also faces out to sea. The front face of the security bulwark may therefore also be considered as that face of the bulwark which is intended to be seaward facing when the bulwark is in use on a vessel or marine installation.

Thus, whereas known security bulwarks are generally mounted over a perimeter railing, that is to say, both on a seaward and an inboard side of the railing, so that the railing bears the weight of the bulwark, the security bulwark of the invention can instead be mounted outside a perimeter railing, that is to say, just on a seaward side of the railing and without the weight of the bulwark bearing directly down on the railing. Mounting the bulwark just on the seaward side of the railing allows the bulwark to be mounted in locations along a perimeter railing where there are other obstructions in the way of the railing, which would otherwise prevent a known type of security bulwark from being mounted over the railing in such a location. These obstructions include support stays for the railing located on an inboard side of the railing. Other obstructions include ones which the perimeter railing has been constructed around, such as fairleads for ropes, and those which are located close to and inboard of the railing on the deck of the vessel or marine installation, such as accommodation ladders, cleats and bitts. Furthermore, the fact that the bulwark can be mounted outside a perimeter railing without the weight of the bulwark bearing directly down on the railing allows the bulwark to be mounted across gaps in the railing which are spanned by freely hanging chains, which are therefore not rigid enough to support the weight of a known type of security bulwark.

As stated above, the front face of the security bulwark comprises a projecting mound, wherein the mound has an underside providing the bulwark with an overhang. Thus, if the bulwark is mounted outside a perimeter railing, the underside of the mound on the front face of the bulwark presents an overhang to any unauthorized potential boarder trying to board the vessel or marine installation from below, for example from a smaller boat brought alongside the vessel or marine installation. The overhang makes it extremely difficult for such a potential boarder to climb up the side of the vessel or marine installation and over the security bulwark in order to gain access to the deck.

The underside of the mound and the overhang which it provides to the bulwark make the bulwark convex in a direction of its height. However, in contrast to known types of security bulwark, since the mound on the front face of the bulwark is also convex in a direction of the breadth of the bulwark, the mound is therefore convex in two different directions. This combination of convexities gives the bulwark improved strength and rigidity in comparison to known types of security bulwark which are only convex in a direction of their height, and a better strength-to-weight ratio than such known types of security bulwark. The greater strength and rigidity of the bulwark also makes it more able to resist impacts from waves, which are dispersed by the double convexity of the mound on the front face of the bulwark.

Furthermore, the fact that the mound on the front face of the bulwark is convex in a direction of the breadth of the bulwark also significantly improves the ability of the bulwark of the invention to thwart unauthorized potential boarders. For example, whereas an unauthorized potential boarder may lean a ladder or climbing pole against a known type of security bulwark which is not convex in a direction of its breadth, if an unauthorized potential boarder tries to lean a ladder or climbing pole against the security bulwark of the invention, the ladder or climbing pole will tend to slide to one side of the mound on the front face of the bulwark rather than being able to lean against it. The convexity of the mound in a direction of the breadth of the bulwark also tends to cause a ladder to twist as it slides. In other words, the convexity of the mound in a direction of the breadth of the bulwark presents an uneven surface, which it is extremely difficult to lean something against, especially from a boat being moved about by waves and swell.

Preferably, the mound has a side surface angled at between 60 and 82 degrees to the front face of the bulwark. By a side surface of the mound is meant a surface of the mound which is not the underside or an upwardly facing surface of the mound if the bulwark is mounted outside a perimeter railing. If the side surface of the mound is angled at more than about 60 degrees, this improves the ability of the mound to present an uneven surface and also increases the strength and rigidity of the bulwark overall. On the other hand, angling the side surface of the mound at less than about 82 degrees also avoids a risk that the mound becomes a projection onto which a ladder or rope may be hooked by a potential boarder. More preferably still, the side surface should be angled at between about 70 and about 80 degrees to the front face of the bulwark.

Preferably, the mound projects more than 400 mm out from the front face of the bulwark. This makes the overhang provided by the underside of the mound more difficult for a potential boarder to negotiate and also gives the bulwark a greater depth overall, making it more difficult to traverse.

Preferably, the mound is not more than 300 mm wide at its furthest projection from the front face of the bulwark. This ensures that a ladder, which is generally more than 300 mm wide, cannot be leant against the mound, although as already noted above, even if it could be, it would tend to slide to one side of the mound due to the convexity of the mound in a direction of the breadth of the bulwark.

Preferably, the mound rises from the front face of the bulwark not more than 150 mm from a side edge of the bulwark. Thus if two bulwarks according to the invention are positioned adjacent to each other side-by-side, a gap between the mound on one bulwark and the mound on the adjacent bulwark is less than 300 mm, which is not wide enough for an unauthorized potential boarder to be able to squeeze their shoulders between the two mounds, thereby thwarting them in trying to gain access to a deck of the vessel or marine installation. 300 mm is also too narrow for an unauthorized potential boarder to be able to fit a ladder, which is generally more than 300 mm wide, between the two mounds.

The front face of the bulwark may comprise more than one such mound arranged side-by-side in a row. Thus the bulwark may comprise two or three such mounds, for example, arranged side-by-side in a row. This correspondingly increases the breadth of the bulwark and therefore the speed and simplicity of mounting a plurality of such bulwarks along the length of a perimeter railing.

Preferably, the front face of the bulwark comprises a pair of such mounds divided by a valley, a deepest part of which is not more than 300 mm wide between the pair of mounds. Thus if the bulwark does comprise more than one mound, any valley between a pair of such mounds is again not wide enough for an unauthorized potential boarder to be able to squeeze their shoulders between the two mounds or to be able to lean a ladder between the two mounds, since as already noted above, a ladder is generally more than 300 mm wide.

Preferably, the deepest part of the valley is curved. Similarly to the convexity of the mound in the direction of the breadth of the bulwark, this has several advantages, as follows. Firstly, it helps to improve the strength and rigidity of the bulwark overall. Secondly, it also presents an uneven surface which it is extremely difficult to lean a ladder against, and which, if a ladder is leant against it, causes the ladder to twist.

Preferably, the deepest part of the valley is more than 150 mm above the front face of the bulwark. This ensures that even where the bulwark is narrower in a front to rear direction due to the presence of the valley, the valley still has an underside which contributes to the overhang provided to the bulwark by the underside of the mounds on each side of the valley. The continuation of the overhang under the valley makes it extremely difficult for a potential boarder to climb over the security bulwark in order to gain access to the deck of the ship. More preferably still, the deepest part of the valley is more than about 200 mm above the front face of the bulwark, thereby improving the effectiveness of the overhang still further.

Preferably, the bulwark has an eyelet formed through the front face of the bulwark, wherein the eyelet is substantially aligned with the deepest part of the valley. The eyelet allows the bulwark to be attached to a perimeter railing by passing a tying member through the eyelet and around both the bulwark and the perimeter railing. The alignment of the eyelet with the deepest part of the valley ensures that the tying member follows the shortest path around both the bulwark and the perimeter railing and is held in place by the pair of mounds on each side of the valley. Preferably, the eyelet is from about 20 mm to about 22 mm in diameter.

Preferably, the bulwark further comprises a side face oriented substantially perpendicular to the front face of the bulwark, wherein the side face comprises a connection site for connecting the bulwark to an adjacent security bulwark. Thus even if the security bulwark cannot be mounted directly to the perimeter railing, for example because of a gap in the railing or an obstruction in the way of the railing, the bulwark can still be positioned in the same location outside the railing and securely mounted in that location by being connected to an adjacent security bulwark which can be mounted to the perimeter railing.

Alternatively, the bulwark preferably further comprises a left side face and a right side face oriented substantially perpendicular to each other, wherein at least one of the left side face and the right side face comprises a connection site for connecting the bulwark to an adjacent security bulwark. The perpendicular left and right side faces allow the security bulwark to be located at a corner of a perimeter railing of a vessel or marine installation where a first substantially straight run of the railing meets a second substantially straight run of the railing, and for the left side of the security bulwark to be positioned alongside a first adjacent bulwark located close to the corner on the first run of railing and the right side of the security bulwark to be positioned alongside a second adjacent bulwark located close to the corner on the second run. The bulwark located at the corner can then be connected to one or both of the adjacent bulwarks via the connection site. This has the advantage that even if the bulwark cannot be mounted directly to the corner of the perimeter railing, it can still be located at the corner and securely mounted in that location by being connected to one or both of the adjacent security bulwarks.

Preferably, the bulwark has a back comprising a recess able to receive the mound on the front face of a similar bulwark, whereby the bulwarks can be nested together. By a back of the bulwark is meant a part of the security bulwark which, if the security bulwark is mounted outside the perimeter railing of a vessel or marine installation, faces in towards a deck of the vessel or marine installation. The back of the security bulwark may otherwise be considered to be that part of the security bulwark which is intended to be deck-facing when the bulwark is in use on a vessel or marine installation. If the bulwark has a back as just described, a plurality of such bulwarks may be nested together for quick and easy transportation. For example, 10 or 15 and up to about 20 such bulwarks may be nested together and stacked on a pallet and then several such pallets may be quickly and easily put in a shipping container using a fork-lift truck, thereby potentially providing enough bulwarks in a single shipping container to secure the perimeter of an entire vessel or marine installation.

If the security bulwark has a rear comprising such a recess, then preferably, the recess is formed by an interior surface of the mound on the front face of the bulwark and the mound further comprises a raised crest adapting the recess to receive a corner of the perimeter railing. If the recess is formed by an interior surface of the mound on the front face of the bulwark, then the bulwark can be made of a single layer of material, for example by being rotation moulded, which gives the bulwark a good strength-to-weight ratio, making it light and easy to handle. However, in such a case, if the bulwark is to be positioned at a corner of the perimeter railing, there is a risk that the projecting corner of the railing will collide with the interior surface of the mound. Giving the mound a raised crest adapting the recess to receive the corner of the railing therefore removes this risk.

Preferably, the bulwark further comprises a borehole running in the direction of the breadth of the bulwark and alongside an uppermost edge of the bulwark. This allows a rod to be passed through the borehole, so that the bulwark can be mounted outside the perimeter railing by being suspended from the rod.

Preferably, the bulwark further comprises a rear panel for mounting inside the perimeter railing, wherein the rear panel is hinged relative to the front face of the bulwark substantially parallel to the uppermost edge of the bulwark. This allows the front face of the bulwark and the rear panel to be hinged apart from each other and for the bulwark to be quickly and easily mounted with the front face of the bulwark outside a perimeter railing and the rear panel inside the perimeter railing. The front face of the bulwark and the rear panel may then be hinged back together and the bulwark attached to the railing.

If the bulwark does comprise such a rear panel, the rear panel preferably comprises an aperture for accommodating an obstruction in the way of the railing. The aperture in the rear panel allows the rear panel to be mounted inside the railing flush to the railing even if there is an obstruction inboard of the railing, such as a support stay of the railing, and for two such bulwarks to be mounted abutting each other side-by-side, without having to leave an unprotected gap between the bulwarks to accommodate the obstruction. The rear panel also helps to protect the perimeter railing from being caught by a grappling iron, hook or the like thrown over the bulwark by an unauthorized potential boarder.

Furthermore, if the rear panel is hinged and the bulwark comprises a borehole as described above, the bulwark preferably further comprises a rod disposed in the borehole and the rear panel is hinged relative to the front face of the bulwark by rotation about the rod, the rod being removable from the borehole, whereby the rear panel is detachable from the rest of the bulwark. Thus, the rear panel may be quickly and easily detached from the rest of the bulwark merely by removing the rod from the borehole or may be just as easily reattached to the rest of the bulwark by reinserting the rod back into the borehole with the rear panel mounted for rotation about the rod. This has several advantages, which include the following.

Firstly, it allows a mixture of bulwarks with and without rear panels to be mounted quickly and easily along a perimeter railing by selecting bulwarks with rear panels where the railings are exposed on their deck side and bulwarks without rear panels where obstructions which are in the way of the railing, such as fairleads, either do not require or prevent the use of a rear panel. Secondly, it allows the rear panels of different bulwarks of the same size to be quickly and easily interchanged with each other, for example to replace a damaged rear panel. Finally, it also allows the rear panel to be stored and transported separately from the rest of the bulwark. Thus, if the bulwark has a rear comprising a recess able to receive the mound on the front face of a similar bulwark as described above, this allows the rear panel to be removed from the rest of the bulwark, thereby exposing the recess, so that the bulwark can be nested together with a similar bulwark.

Preferably, the bulwark has a height of between 500 mm and 1000 mm. More preferably still, it has a height of between 500 mm and 750 mm. The regulation height of a ship's railing is at least 1 metre from a deck of the ship on which the railing is mounted. Known types of security bulwark are generally more than a metre in height, so that if such a known type of bulwark is mounted over the railing, the railing is completely covered by the bulwark, which may also extend further down the outside of the ship. As already noted above, this has the disadvantage of preventing ropes and chains from being passed by crew members under or through a railing on which the bulwark is mounted, who instead tend to pass the ropes and chains from the deck over the top of the security bulwark, creating a risk of damage to the bulwark and possibly also to the railing on which it is mounted. If, however, the bulwark has a height less than about 1000 mm, and more preferably less than about 750 mm, this leaves a gap between a lowermost edge of the bulwark and the deck, through which crew members can still pass ropes and chains, thereby reducing the risk of damage to the bulwark or to the railing on which it is mounted.

Moreover, a security bulwark which is more than a metre in height and which therefore completely covers a railing on which it is mounted, has the disadvantage that in high seas, if waves break on to the deck, seawater from such waves can be contained on the deck by the bulwark and prevented from washing back over the edge of the ship into the sea. Seawater thus contained on the deck may slosh around on the deck, which can affect the ship's stability, a problem generally known in the art as "free surface effect". However, regulations also require that an opening between the lowest course of rails in a ship's railing and the deck shall not exceed 230 mm. Thus if the bulwark has a height of between about 500 mm and about 1000 mm, and more preferably still, between about 500 mm and about 750 mm, this ensures that all of the openings between the courses of rails in a railing to which the bulwark is mounted, from the lowest course of rails to the topmost handrail, are at least partially covered by the bulwark, whilst still leaving a gap between the lowermost edge of the bulwark and the deck to allow seawater from waves which break on to the deck to wash back over the edge of the ship into the sea. Such a gap does not compromise the security which the bulwark provides for two reasons, however, as follows. Firstly, the deck of a ship is also provided with a vertical lip at its edge called a fishplate, which can at least partially hide the gap between the lowest course of rails and the deck from unauthorized potential boarders. Secondly, since the lowest course of rails in the ship's railing is no more than 230 mm above the deck, an unauthorized potential boarder is unable to squeeze through the gap between the lowermost edge of the bulwark and the deck because this is obstructed by the lowest course of rails.

Regulations governing the heights of fishplates on ships mean that the height of the fishplate depends on the nature and size of the ship. Preferably, however, the mound on the bulwark is shaped and sized so as to accommodate fishplates from about 90 mm up to about 400 mm in height, which is the maximum height of a fishplate on a very large crude carrier (VLCC).

In a second aspect, the present invention also provides a perimeter protection system comprising a plurality of security bulwarks according to the first aspect of the invention arranged side-by-side and adjacent to each other. Since the plurality of security bulwarks are all the same as each other and do not require any modification in order to be installed on a vessel or marine installation, they are easy to mount in place, remove and replace. Thus the perimeter of the vessel or marine installation may be protected quickly and easily by arranging such a plurality of security bulwarks side-by-side and adjacent to each other along a perimeter railing of the vessel or marine installation, by mounting them outside the railing.

If the security bulwarks each have a respective side face comprising a connection site for connecting the respective bulwark to an adjacent security bulwark, the perimeter protection system preferably further comprises at least one connector for attaching the adjacent security bulwarks together at the respective connection sites on the side faces thereof. This allows the adjacent security bulwarks to be attached together to provide a continuous barrier with no gaps between the adjacent security bulwarks, and gives greater overall structural integrity and strength to the perimeter protection system than if the adjacent security bulwarks were not connected together. On the other hand, it also uses the security bulwarks in a most economical fashion by protecting the greatest length of railing possible, rather than for example, by overlapping adjacent security bulwarks and connecting them together, as in some known types of perimeter protection system.

In the minimal case where the perimeter protection system comprises just two adjacent security bulwarks, each of the adjacent security bulwarks can have two but need only have one such side face, located on the side of each bulwark which is nearest to the adjacent bulwark. If, however, the perimeter protection system comprises more than two adjacent security bulwarks, each of the adjacent security bulwarks will generally have two such side faces, one located on each side of the respective bulwark, apart from the two bulwarks at each end of the adjacent security bulwarks, which again need only have one such side face, located on the side of the respective bulwark which is nearest to the adjacent bulwark.

If the security bulwarks each comprise a borehole as described above, the perimeter protection system preferably comprises three adjacent security bulwarks and a rod passing through the borehole of a central one of the three adjacent security bulwarks and into the respective boreholes of a leftmost one and a rightmost one of the three adjacent security bulwarks. Thus the leftmost and rightmost bulwarks can be attached to a railing of the vessel, and the central security bulwark can be mounted outside the railing by suspension from the rod. This allows the central bulwark to be positioned outside a gap in the railing which is spanned by freely hanging chains, which are therefore not rigid enough to support a security bulwark, and for the weight of the central bulwark to be borne by the leftmost and rightmost security bulwarks. Thus the central bulwark can protect the gap in the ship's railing against a potential boarder without having to be attached to the chains across the gap, and the leftmost and rightmost security bulwarks can be secured to the ship's railing on either side of the gap instead. If each of the adjacent security bulwarks also has a respective side face substantially perpendicular to the front face of the respective bulwark, the central, leftmost and rightmost security bulwarks may be additionally connected together as described above, with their respective side faces abutting each other, to give them greater overall structural integrity and strength as well.

Preferably, the perimeter protection system further comprises a spacer positioned between and abutting each of an adjacent pair of the plurality of security bulwarks. This allows the overall length of the perimeter protection system to be increased by the width of the spacer, in order to approximate the overall length of the perimeter protection system more closely to the length of the perimeter railing on which it is installed, without having to overlap or modify any of the security bulwarks in the system.

Preferably, the spacer comprises a through-hole for connecting the adjacent pair of the plurality of security bulwarks to each other via the spacer. This allows the adjacent security bulwarks to be attached together in spite of the presence of the spacer, and for the spacer to be secured to them both.

Preferably, the various elements of the perimeter protection system are constituted of one or more materials which are resistant to weather and seawater, such as inert plastics materials. For example, the major components of the perimeter protection system, including each security bulwark and any rods, connectors and spacers, may be made of high density polyethylene (HDPE) and/or of glass reinforced nylon, both of which also have good strength and rigidity.

At least the front face of each bulwark, as well as possibly also any rear panel, may be brightly coloured to advertise the presence of the perimeter protection system to unauthorized potential boarders and to deter them from approaching the vessel or marine installation. Preferably, they are coloured safety orange.

In a third aspect, the present invention also provides a vessel or marine installation comprising a perimeter protection system as described herein arranged along the perimeter of the vessel or marine installation. If so, the vessel or marine installation may further comprise cargo protected by the perimeter protection system.

In a fourth aspect, the present invention also provides a method of protecting a perimeter of a vessel or marine installation, the method comprising positioning a plurality of security bulwarks according to the first aspect of the invention side-by-side and adjacent to each other along a perimeter railing of the vessel or marine installation, attaching some of the plurality of security bulwarks to the railing, and connecting remaining ones of the plurality of security bulwarks which are not attached to the railing to ones of the plurality of security bulwarks which are attached to the railing. Thus the perimeter of a vessel or marine installation can be protected by a continuous run of security bulwarks without any gaps between them, even though only some of the plurality of security bulwarks are attached to the railing.

Preferably, this method further comprises positioning at least one of the plurality of security bulwarks which are not attached to the railing in front of a gap in the railing or an obstruction in the way of the railing or at a corner of the railing. By in front of is meant outside or on a seaward side of the railing. Thus a gap in the railing or an obstruction in the way of the railing, as well as a corner of the railing, which might otherwise prevent a known type of security bulwark from being positioned in such a location can be bridged by a bulwark which is not attached to the railing and is instead connected to ones of the plurality of security bulwarks which are attached to the railing.

Preferably, the method further comprises positioning a spacer between and abutting each of an adjacent pair of the plurality of security bulwarks. Thus the overall length of the plurality of security bulwarks can be increased by a width of the spacer, in order to approximate the overall length of the plurality of security bulwarks more closely to the length of the perimeter railing along which they are positioned, without having to overlap or modify any of the security bulwarks.

Preferably, the method further comprises connecting the adjacent pair of the plurality of security bulwarks to each other using a through-hole of the spacer, whereby the adjacent security bulwarks can be attached together in spite of the presence of the spacer, and the spacer can be secured to them both.

Further features and advantages of the present invention will become apparent from the following detailed description, which is given by way of example and in association with the accompanying drawings, in which.

Figure 1:
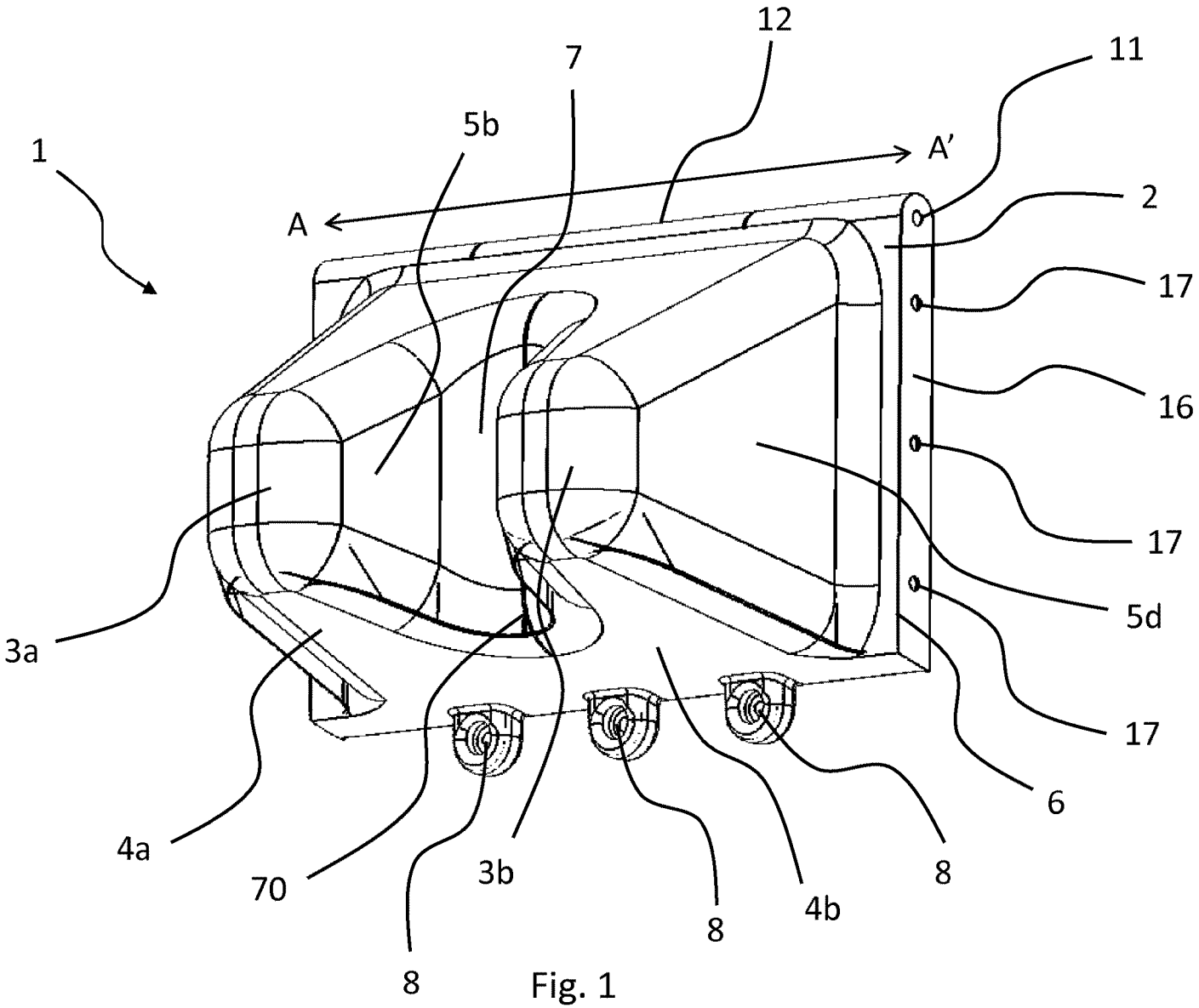
FIG. 1 is a perspective view of a front face of a first embodiment of a security bulwark.
Figure 2:
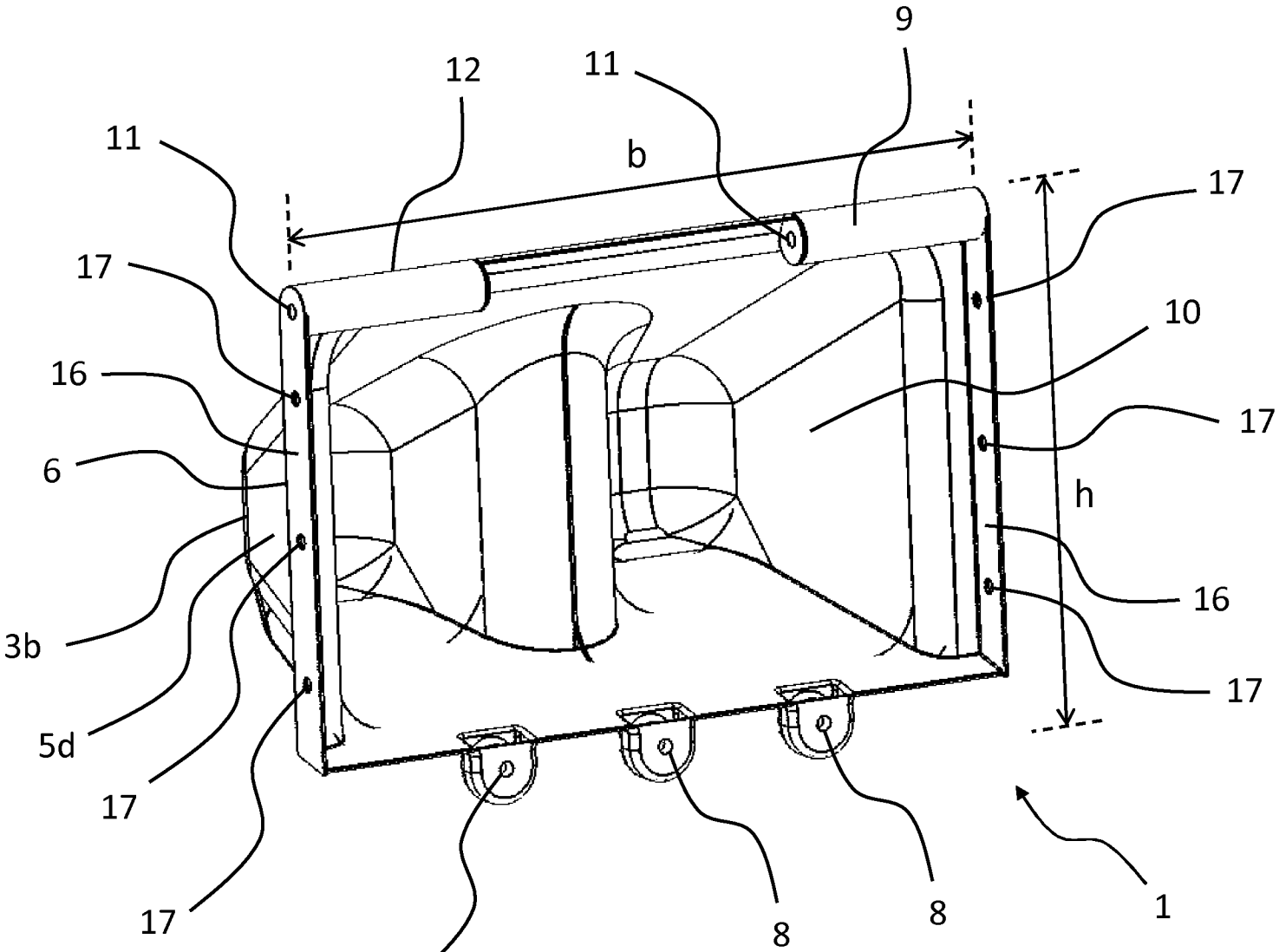
FIG. 2 is a perspective view of a back of the security bulwark shown in FIG. 1.
Figure 3:
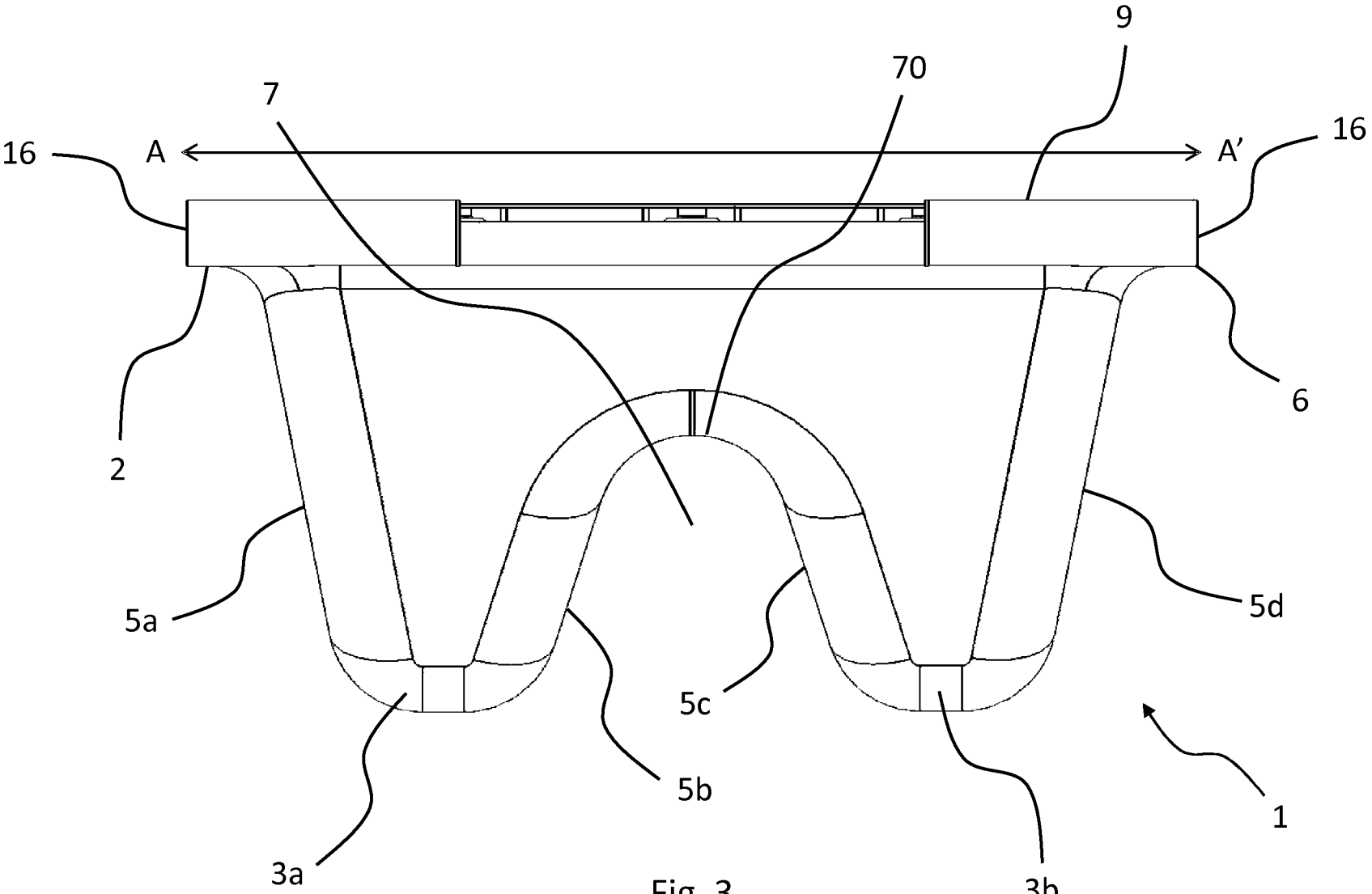
FIG. 3 is a top plan view of the security bulwark shown in FIGS. 1 and 2.

FIGS. 1 to 3 are three different views of a first embodiment of a security bulwark 1 for mounting outside a perimeter railing of a vessel or marine installation. The bulwark 1 has a front face 2 comprising a pair of projecting mounds 3*a*, 3*b*, which are divided by a valley 7. Each mound has an underside 4*a*, 4*b*, which provide the bulwark 1 with an overhang. Each mound 3*a*, 3*b* is convex in a direction A-A' of the breadth of the bulwark 1. Each mound 3*a*, 3*b* has a respective pair of side surfaces 5*a*, 5*b*; 5*c*, 5*d*, all of which are angled at between 60 and 82 degrees to the front face 2 of the bulwark 1. The respective outer side surfaces 5*a*, 5*d* of each mound 3*a*, 3*b* are both angled at approximately 78.8 degrees to the front face 2 of the bulwark 1 and the respective inner side surfaces 5*b*, 5*c* of each mound 3*a*, 3*b*, in other words, those which are adjacent to the valley 7, are angled at approximately 72.1 degrees to the front face 2 of the bulwark 1. As can be seen from FIG. 3, the side surfaces 5*a*, 5*b*; 5*c*, 5*d* are all substantially flat.

Each mound 3*a*, 3*b* projects approximately 473 mm out from the front face 2 of the bulwark 1. Each mound 3*a*, 3*b* is approximately 240 mm wide at its furthest projection from the front face 2 of the bulwark 1, that is to say from where the part of each mound 3*a*, 3*b* starts to curve from the respective side surfaces 5*a*, 5*b*; 5*c*, 5*d*. Each mound 3*a*, 3*b* rises from the front face 2 of the bulwark 1 approximately 35 mm from a side edge 6 of the bulwark 1. The deepest part 70 of the valley 7, that is to say the part of the valley 7 which does not include the inner side surfaces 5*b*, 5*c*, is also curved and is approximately 193 mm wide where the deepest part 70 of the valley 7 meets the inner side surfaces 5*b*, 5*c*. The deepest part 70 of the valley 7 is also approximately 179 mm above the front face 2 of the bulwark 1.

As may best be seen in FIG. 1, the security bulwark 1 has a plurality of eyelets 8 formed through the front face 2 of the bulwark 1. A central one of these eyelets 8 is substantially aligned with the deepest part 70 of the valley 7. Thus the bulwark 1 can be attached to a perimeter railing by passing a tying member through this central eyelet 8 and around both the bulwark 1 and the perimeter railing. The alignment of the central eyelet 8 with the deepest part 70 of the valley 7 ensures that the tying member follows the shortest path around both the bulwark 1 and the perimeter railing and is held in place by the pair of mounds 3*a*, 3*b* on each side of the valley 7.

The bulwark 1 has two side faces 16 oriented substantially perpendicular to the front face 2 of the bulwark 1. Each side face 16 comprises a plurality of connection sites 17 for connecting the bulwark 1 to an adjacent security bulwark. The connection sites 17 each comprise a through-hole formed in the respective side 16 of the bulwark 1 and which is able to receive a connector 18, such as a bolt. The bulwark 1 further comprises two boreholes 11, which are longitudinally aligned with each other and run in a direction A-A' of the breadth of the bulwark 1, alongside an uppermost edge 12 of the bulwark 1. These boreholes 11 are each able to receive a rod therein in the direction A-A'.

The security bulwark 1 has an overall height, h, from the uppermost edge 12 of the bulwark 1 to a lowermost part thereof, which includes the plurality of eyelets 8, of 755 mm. Thus all of the gaps between the courses of rails in a railing to which the bulwark 30 is mounted, from the lowest course of rails to the topmost handrail, can be at least partially covered by the bulwark 1, whilst still leaving an opening between a lowermost edge of the bulwark and the deck, to allow seawater from waves which break on to the deck to wash back over the edge of the vessel or marine installation into the sea. The security bulwark 1 also has a breadth, b, from one to the other of the two side faces 16 of 1078 mm, which is sufficiently large to cover a length of perimeter railing quickly and easily with a plurality of such bulwarks, whilst also being sufficiently small for one person to be able to handle the bulwark 1 with ease when mounting it to a railing.

Figure 4:
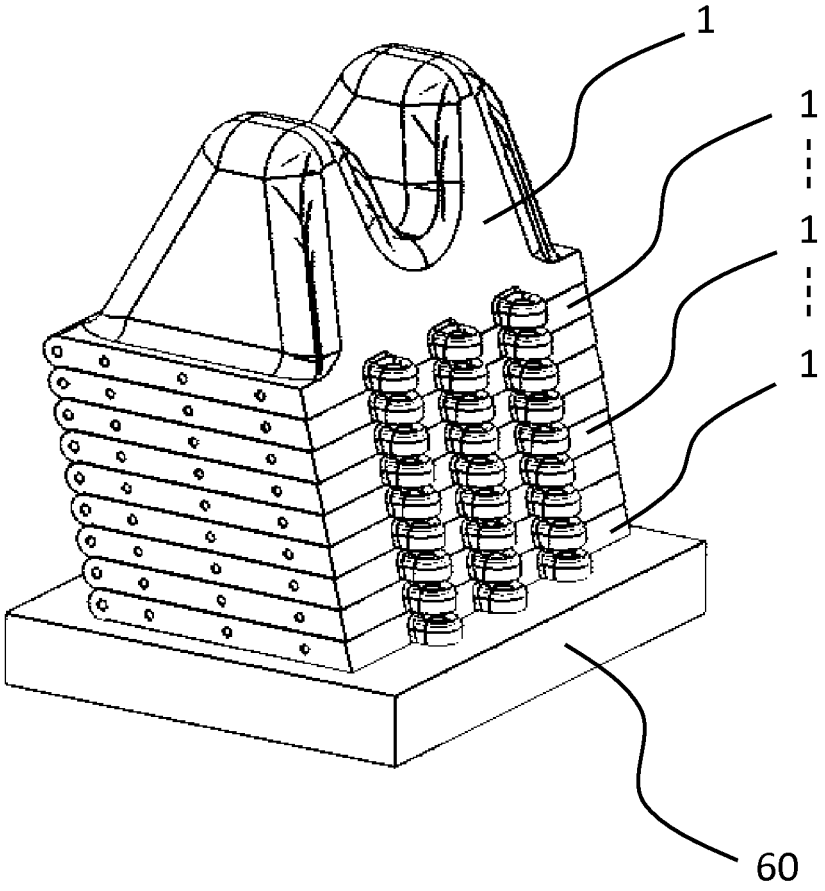
FIG. 4 is a perspective view of a plurality of the security bulwarks shown in FIGS. 1 to 3 nested together.

As may best be seen in FIG. 2, the security bulwark 1 has a back 9 comprising a recess 10 able to receive the pair of mounds 3*a*, 3*b* on the front face 2 of a similar bulwark. Thus a plurality of such similar bulwarks 1 can be nested together in the manner shown in FIG. 4, wherein nine such similar bulwarks 1 have been nested together and stacked on a shipping pallet 60 for quick and easy transportation.

Figure 5:
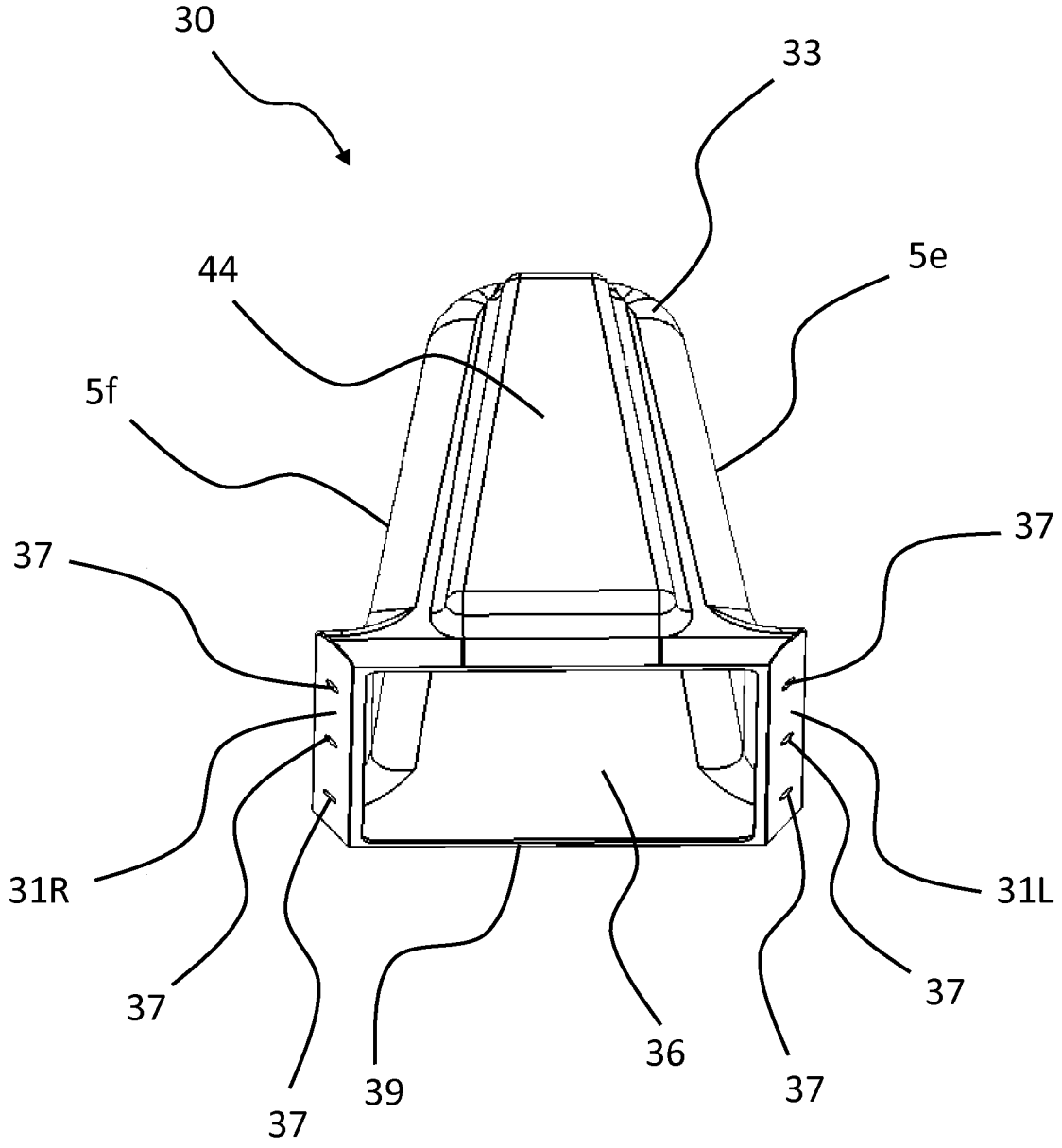
FIG. 5 is a perspective view from behind and above of a second embodiment of a security bulwark.
Figure 6:
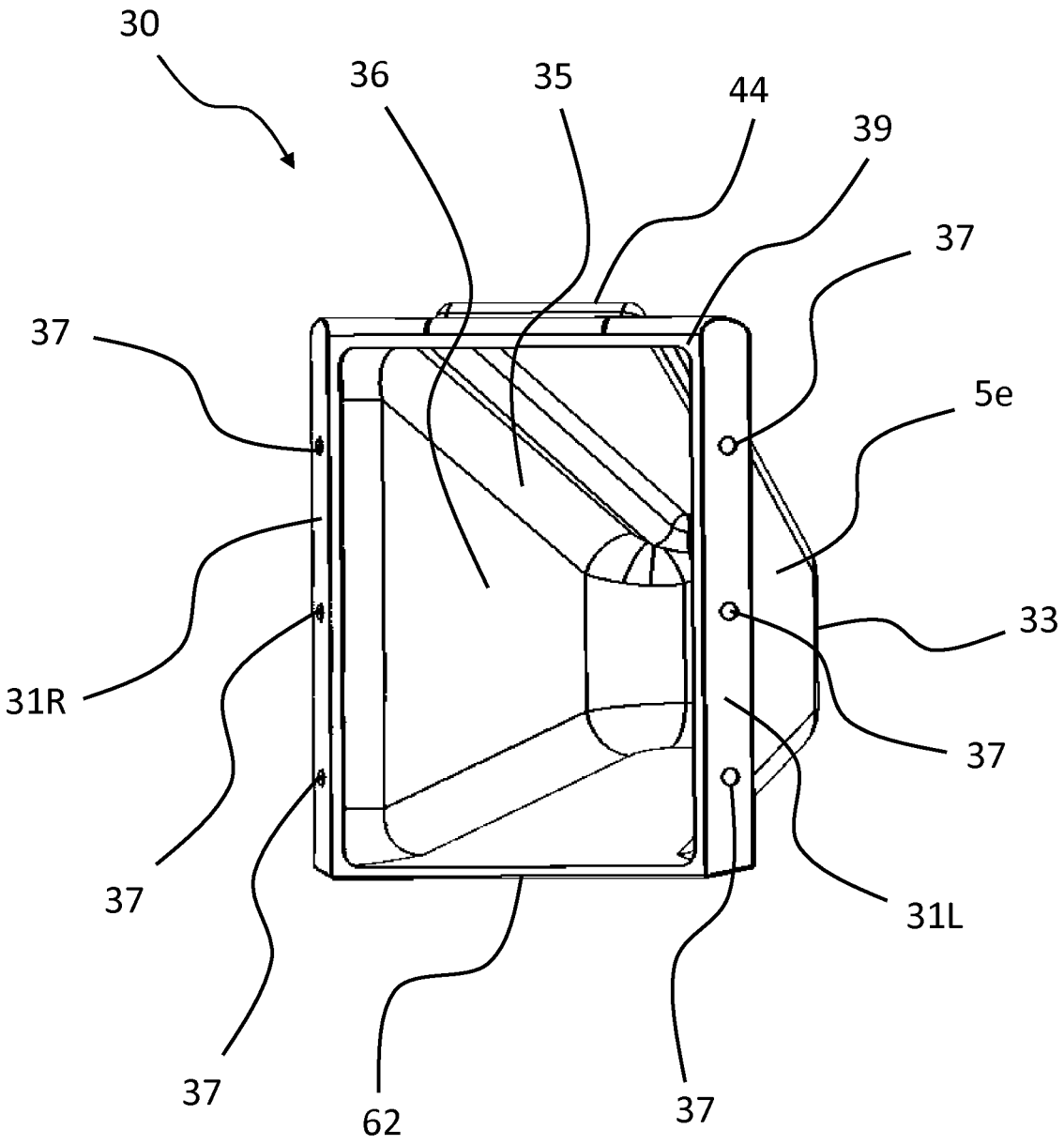
FIG. 6 is perspective view of a back of the security bulwark shown in FIG. 5.
Figure 7:
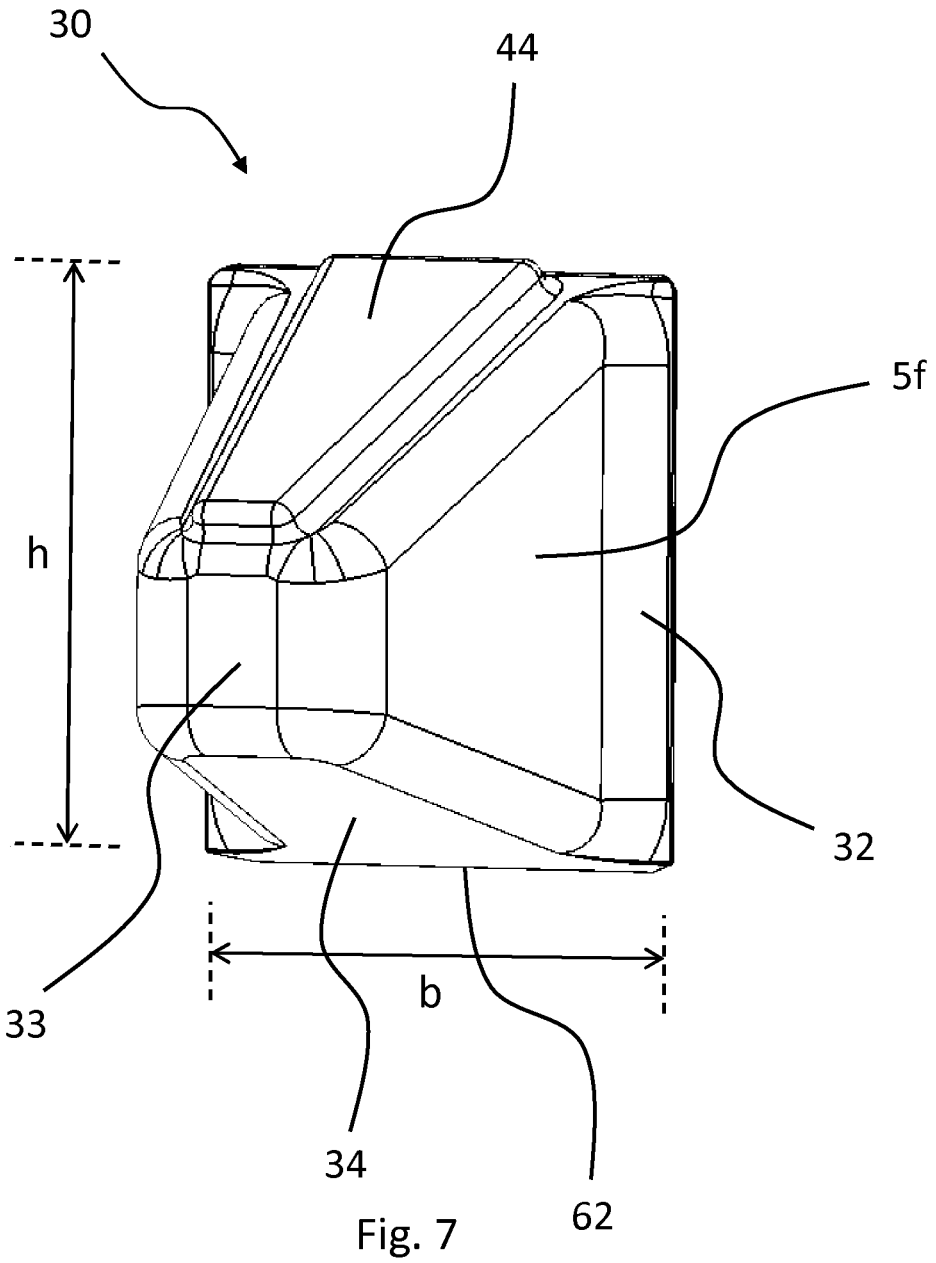
FIG. 7 is a perspective view of a front face of the security bulwark shown in FIGS. 5 and 6.

FIGS. 5 to 7 are three different views of a second embodiment of a security bulwark 30 suitable for location at a corner of a perimeter railing of a vessel or marine installation. In contrast to the security bulwark 1 shown in FIGS. 1 to 3, the security bulwark 30 has a left side 31L and a right side 31R which are oriented substantially perpendicular to each other. Each of the left side 31L and the right side 31R comprises a plurality of connection sites 37 for connecting the security bulwark 30 to an adjacent security bulwark. The connection sites 37 each comprise a through-hole formed in the respective one of the left side 31L and the right side 31R of the bulwark 30 and which is able to receive a connector 18, such as a bolt.

The bulwark 30 has a front face 32 comprising a projecting mound 33. The mound 33 has an underside 34, which provides the bulwark with an overhang, and is convex in a direction from the left side 31L to the right side 31R of the bulwark 30. The mound 33 has a pair of side surfaces 5*e*, 5*f* which are angled at between 60 and 82 degrees to the front face 32 of the bulwark 30. As can be seen from FIG. 5, the side surfaces 5*e*, 5*f* are both substantially flat. The mound 33 rises from where the front face 32 meets the left and right sides 31L, 31R of the bulwark 30 and projects more than 400 mm out from the front face 32 of the bulwark 30. The mound 33 is not more than 300 mm wide at its furthest projection from the front face 32 of the bulwark 30, that is to say, from where the mound 33 starts to curve from the side surfaces 5*e*, 5*f*.

The security bulwark 30 has a height, h, of between 500 mm and 1000 mm, which is substantially equal to the height of the security bulwark 1 shown in FIGS. 1 to 3 minus the height of each of the plurality of eyelets 8 on the front face 2 thereof. Thus all of the gaps between the courses of rails in a railing to which the bulwark 30 is mounted, from the lowest course of rails to the topmost handrail, are at least partially covered by the bulwark 30, whilst still leaving an opening between a lowermost edge 62 of the bulwark and the deck, to allow seawater from waves which break on to the deck to wash back over the edge of the vessel or marine installation into the sea. The security bulwark 30 also has a breadth, b, of between 350 mm and 700 mm. Thus the bulwark 30 is able to cover a corner of a perimeter railing of any thickness generally found on a vessel or marine installation, whilst also being sufficiently small for one person to be able to handle the bulwark with ease in order to locate it at the corner.

As may best be seen in FIG. 6, the security bulwark 30 has a back 39 opposite to the front face 32. The back 39 comprises a recess 36 to receive the corner of a perimeter railing of a vessel or marine installation. The recess 36 is formed by an interior surface 35 of the projecting mound 33. The mound 33 further comprises a raised crest 44 adapting the recess 36 to receive the corner of the perimeter railing. The recess 36 is also able to receive the mound 33 on the front face 32 of a similar bulwark 30, whereby two or more such bulwarks 30 can be nested together in a similar manner to that shown in FIG. 4 for the bulwark 1.

Figure 8:
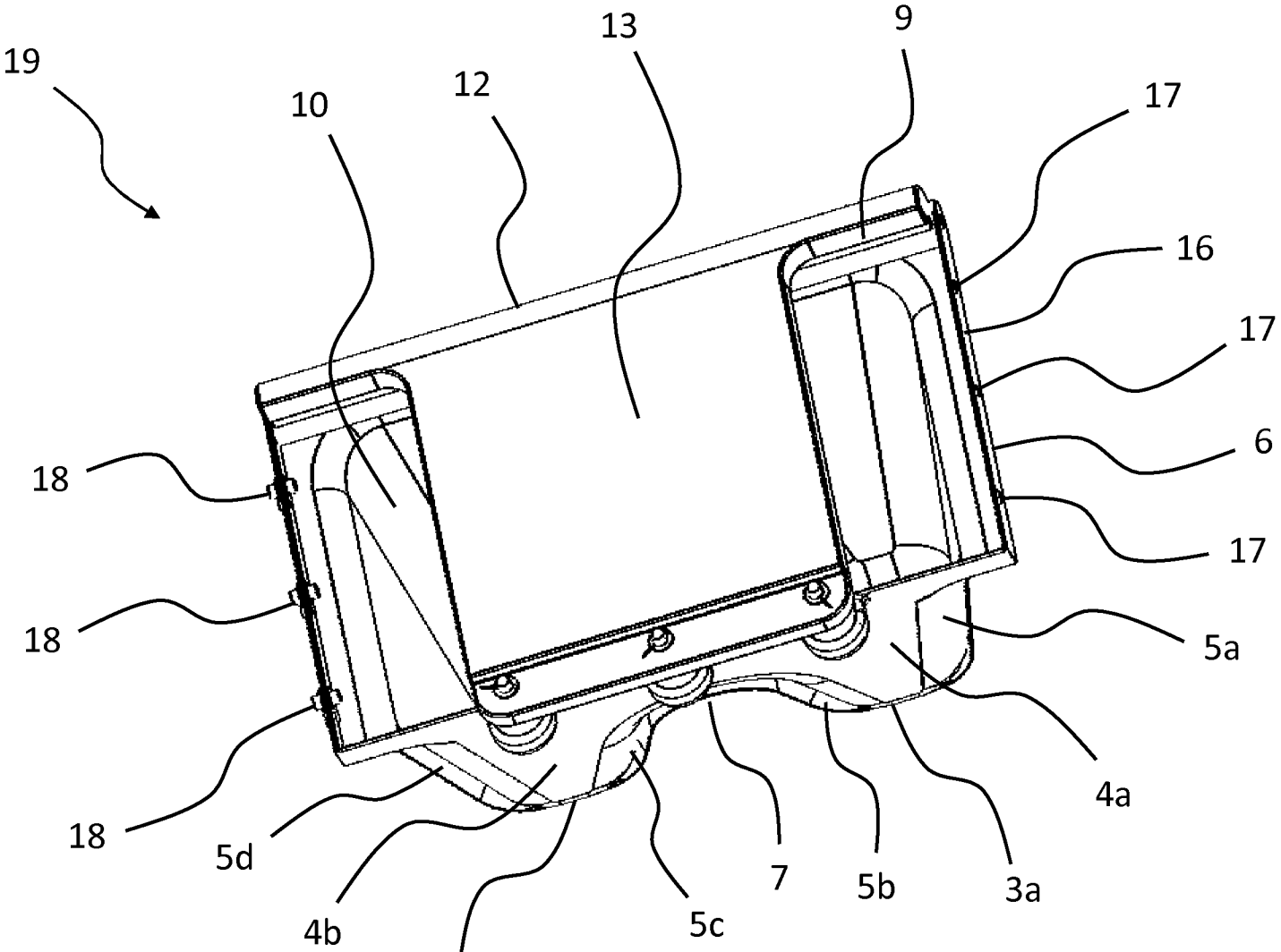
FIG. 8 is a first perspective view of a back of a third embodiment of a security bulwark.
Figure 9:
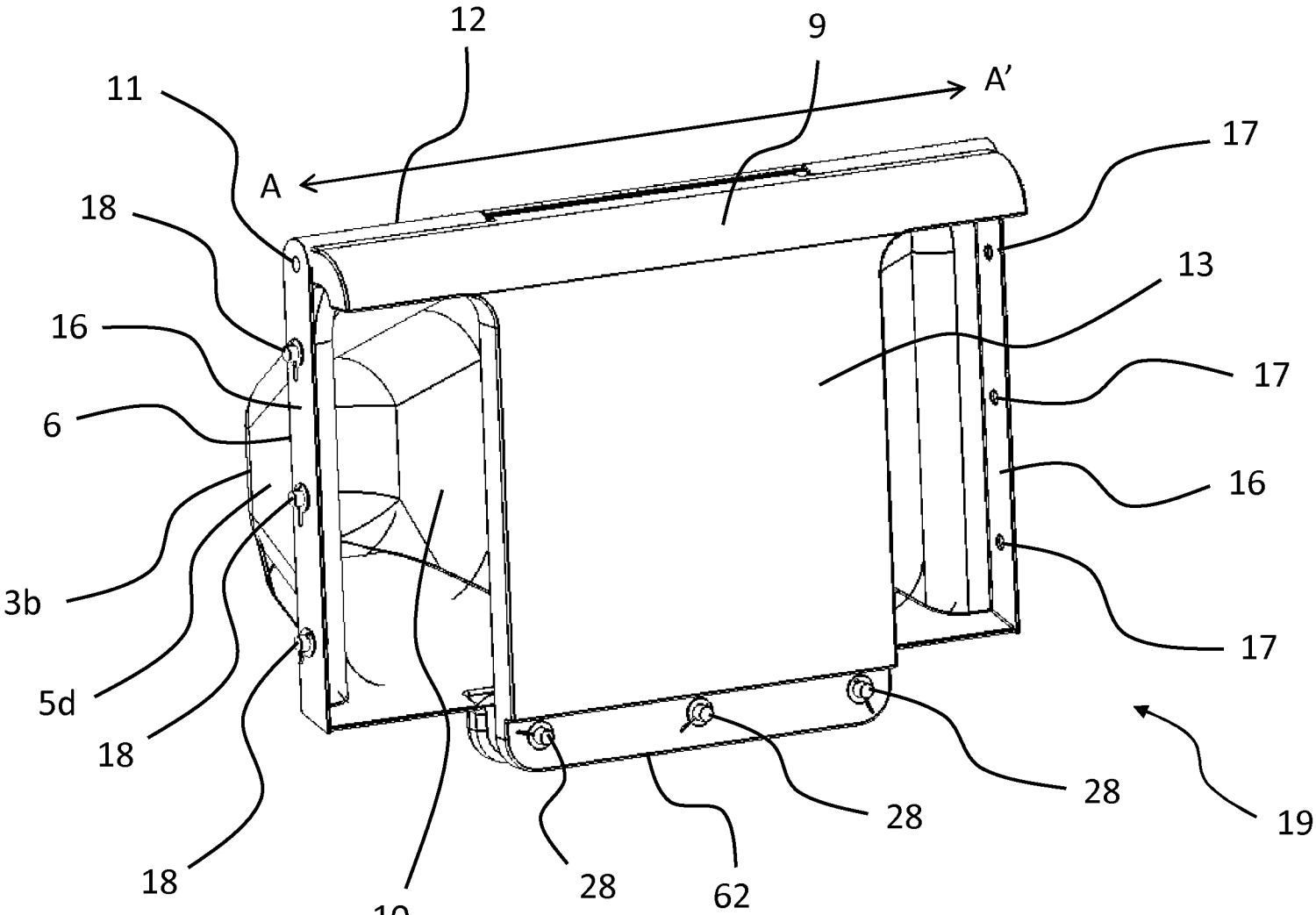
FIG. 9 is a second perspective view of the back of the security bulwark shown in FIG. 8.
Figure 10:
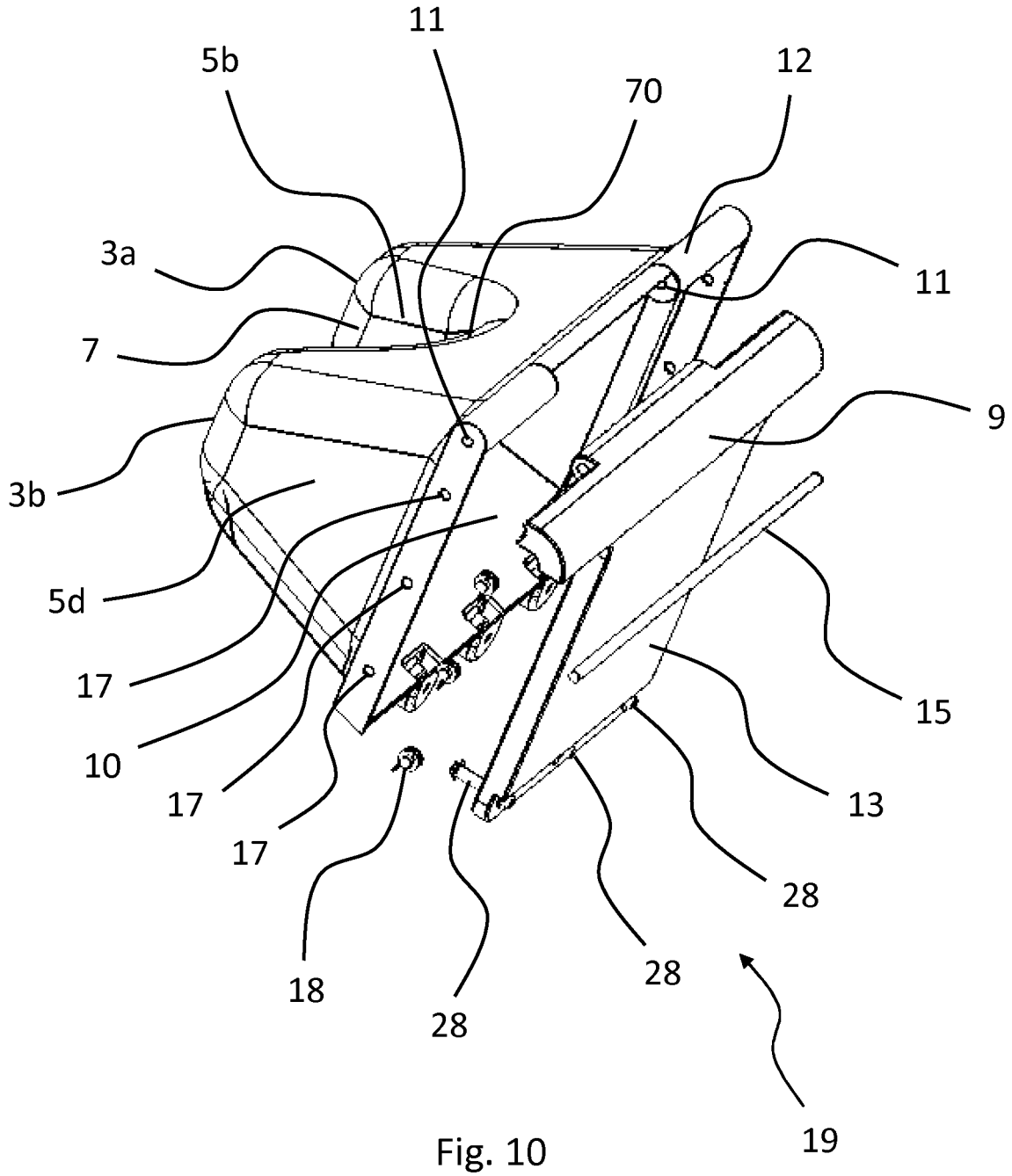
FIG. 10 is an exploded perspective view of the security bulwark shown in FIGS. 8 and 9.

FIGS. 8 to 10 are three different views of a third embodiment of a security bulwark 19 for mounting along a perimeter railing of a vessel or marine installation. The security bulwark 19 has a front face 2 and two sides 16, all of which are the same as those of the security bulwark 1 shown in FIGS. 1 to 3 and comprise the same features. The security bulwark 19 differs from the security bulwark 1, however, in that it further comprises a rear panel 13 on the back 9 thereof for mounting inside a perimeter railing of a vessel or marine installation. The rear panel 13 is shown in more detail in FIGS. 11 and 12. As may best be seen in FIG. 11, the rear panel 13 comprises a borehole 45, which is located between and longitudinally aligned with the two boreholes 11 described above in relation to the security bulwark 1. Like the two boreholes 11, the borehole 45 also runs in the direction A-A' of the breadth of the bulwark 19, alongside an uppermost edge 12 of the bulwark 19. Thus a rod 15 can be inserted into a first one of the two boreholes 11, through the borehole 45 in the rear panel 13 and then into a second one of the two boreholes 11, so that the rear panel 13 can be hinged relative to the front face 2 of the bulwark 19 substantially parallel to the uppermost edge 12 of the bulwark 19 by rotation about the rod 15. Moreover, the rod 15 is removable from the boreholes 11, 45, so that the rear panel 13 can be detached from the rest of the bulwark 19.

As may best be seen in the exploded view of FIG. 10, however, even when the rear panel 13 is attached to the rest of the bulwark 19 via the rod 15, the shape of the rear panel 13 is such that the rear panel 13 can adopt a position in which it is parallel to but spaced apart from the front face 2 of the security bulwark 19. The separation of the rear panel 13 from the front face 2 in this position is sufficiently great to accommodate the thickness of any perimeter railing generally found on a vessel or marine installation. Thus the rear panel 13 can be hinged apart from the front face 2 of the bulwark 19, and the bulwark 19 can be mounted over a perimeter railing, with the front face 2 disposed on the outside or seaward side of the railing and the rear panel 13 on the inside or deck side of the railing. The rear panel 13 and the rest of the bulwark 19 can then be hinged back together until the rear panel 13 is parallel to but spaced apart from the front face 2 of the security bulwark 19 once again. In this position, a lowermost edge 62 of the rear panel 13 aligns with the lowermost part of the front face 2, which includes the plurality of eyelets 8, so that the overall height of the security bulwark 19 is the same as that of the security bulwark 1.

Figure 11:
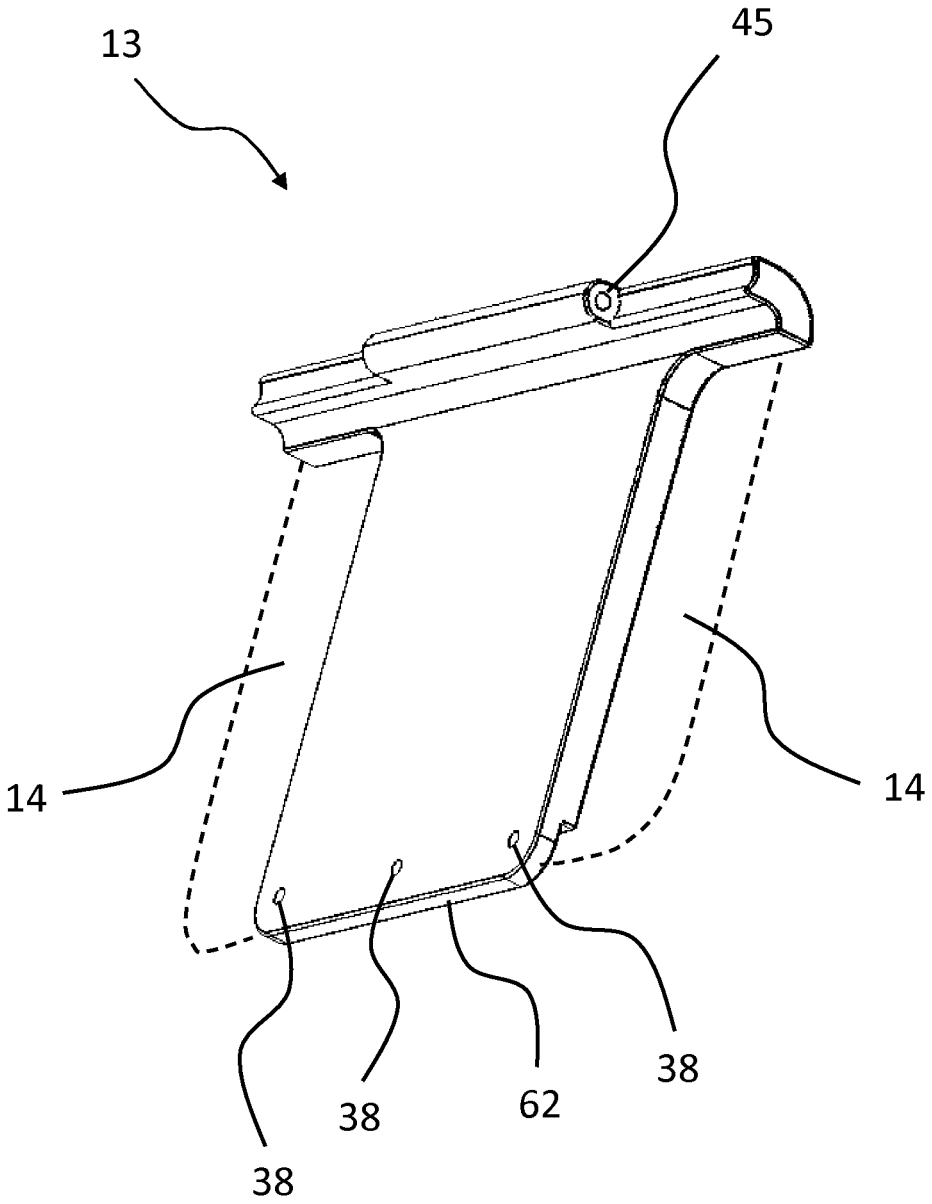
FIG. 11 is a first perspective view of a rear panel of the security bulwark shown in FIGS. 8 to 10.
Figure 12:
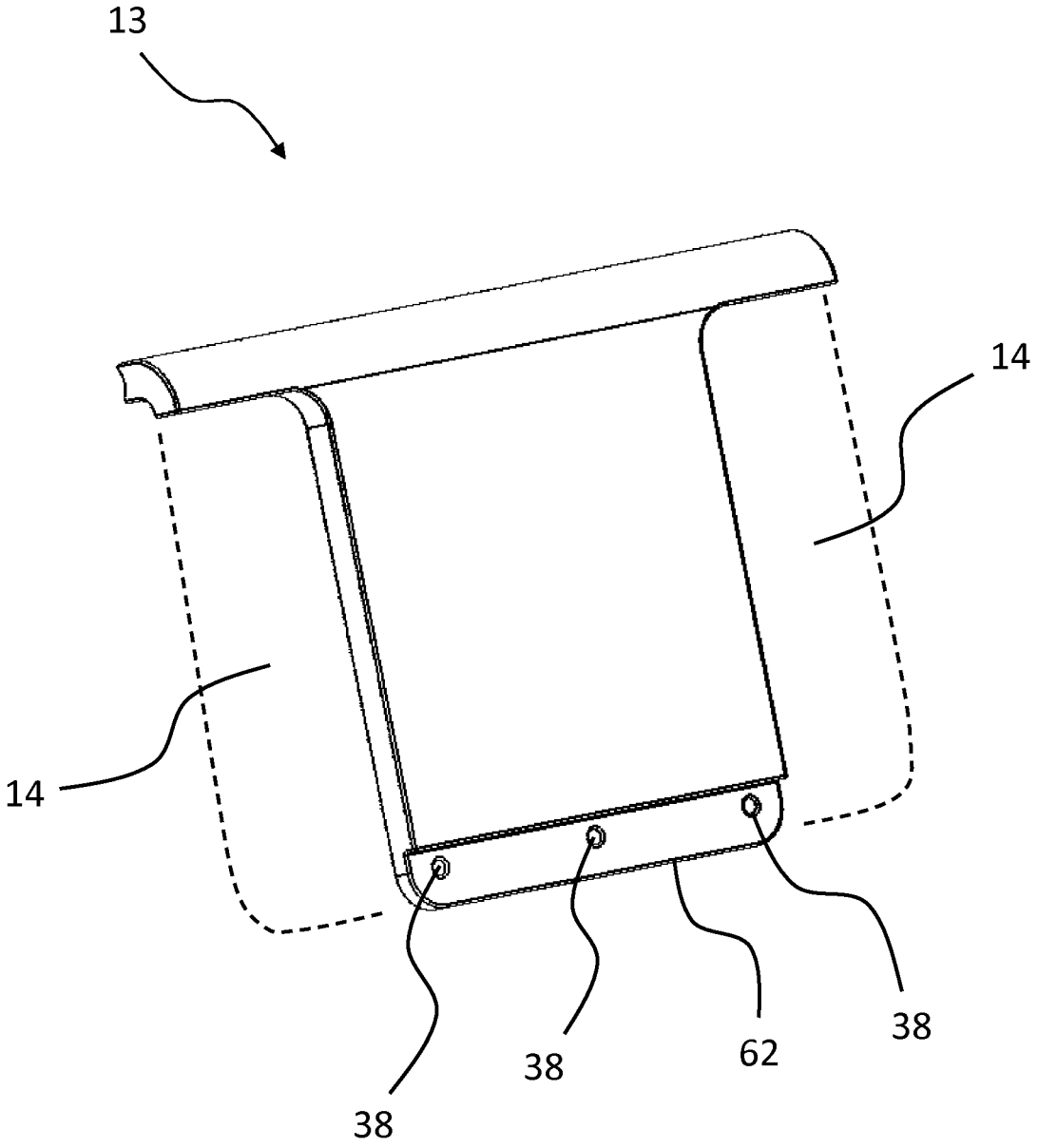
FIG. 12 is a second perspective view of the rear panel shown in FIG. 11.

As can be seen in FIGS. 11 and 12, the rear panel 13 comprises a plurality of connection sites 38, for connecting the rear panel 13 to the front face 2 of the security bulwark 19. The connection sites 38 each comprise a through-hole formed in the rear panel 13 which is able to receive a connector 28, such as a bolt. The locations of the connection sites 38 on the rear panel 13 correspond to the locations of the eyelets 8 on the front face 2 of the security bulwark 19. Thus once the bulwark 19 has been mounted over a perimeter railing, a connector 28, such as a bolt, can be inserted into a through-hole at one of the connection sites 38 on the rear panel 13 and through the corresponding one of the eyelets 8 on the front panel 2, in a direction perpendicular to the perimeter railing over which the bulwark 19 has been mounted. The bolt can then be fitted with a nut, for example, and both can be tightened together until the rear panel 13 and the front face 2 are secured together, thereby preventing the security bulwark 19 from being removed from the perimeter railing to which it has been mounted without firstly undoing the connector 28.

As may also be seen in FIGS. 11 and 12, the rear panel 13 further comprises two apertures 14 or "cut-outs" for accommodating an obstruction in the way of the railing. Thus the rear panel 13 does not completely cover the recess 10 in the back 9 of the security bulwark 19 in the location of each of the apertures 14, as can be seen in FIGS. 8 and 9. This means that if two such security bulwarks 19 are mounted side-by-side adjacent to each other over a perimeter railing, one of the apertures 14 on a first one of the two adjacent security bulwarks 19 will be adjacent to another such aperture 14 on the other of the two adjacent security bulwarks 19. The two adjacent apertures 14 thus allow the two adjacent security bulwarks 19 to be positioned on the railing either side of a location where there is an obstruction on the inside or deck side of the railing, and for the respective sides 16 of the two adjacent security bulwarks 19 to abut each other with the obstruction accommodated in the combined space created by the two adjacent apertures 14.

Figure 13:
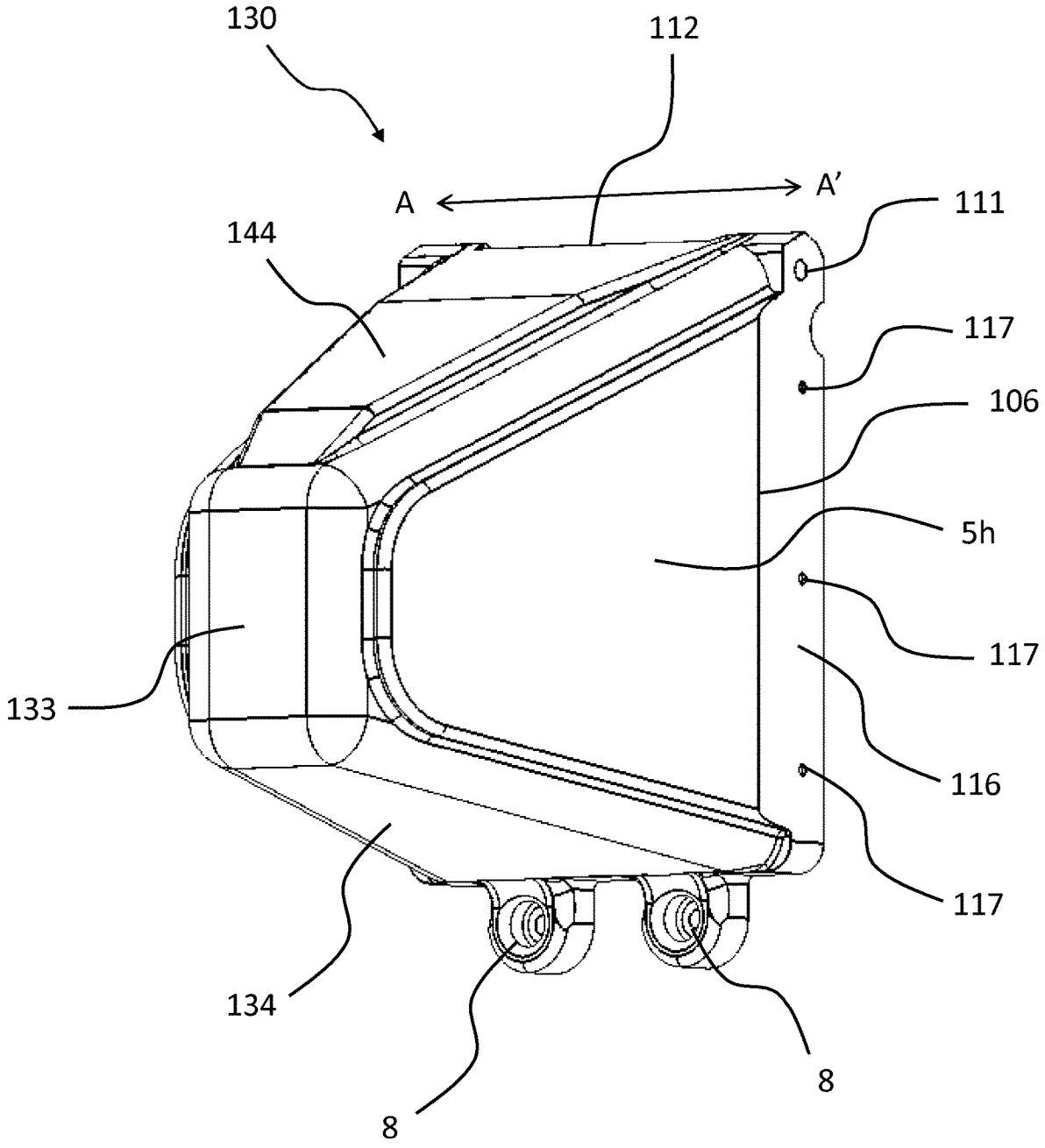
FIG. 13 is a perspective view of a front face of a fourth embodiment of a security bulwark.
Figure 14:
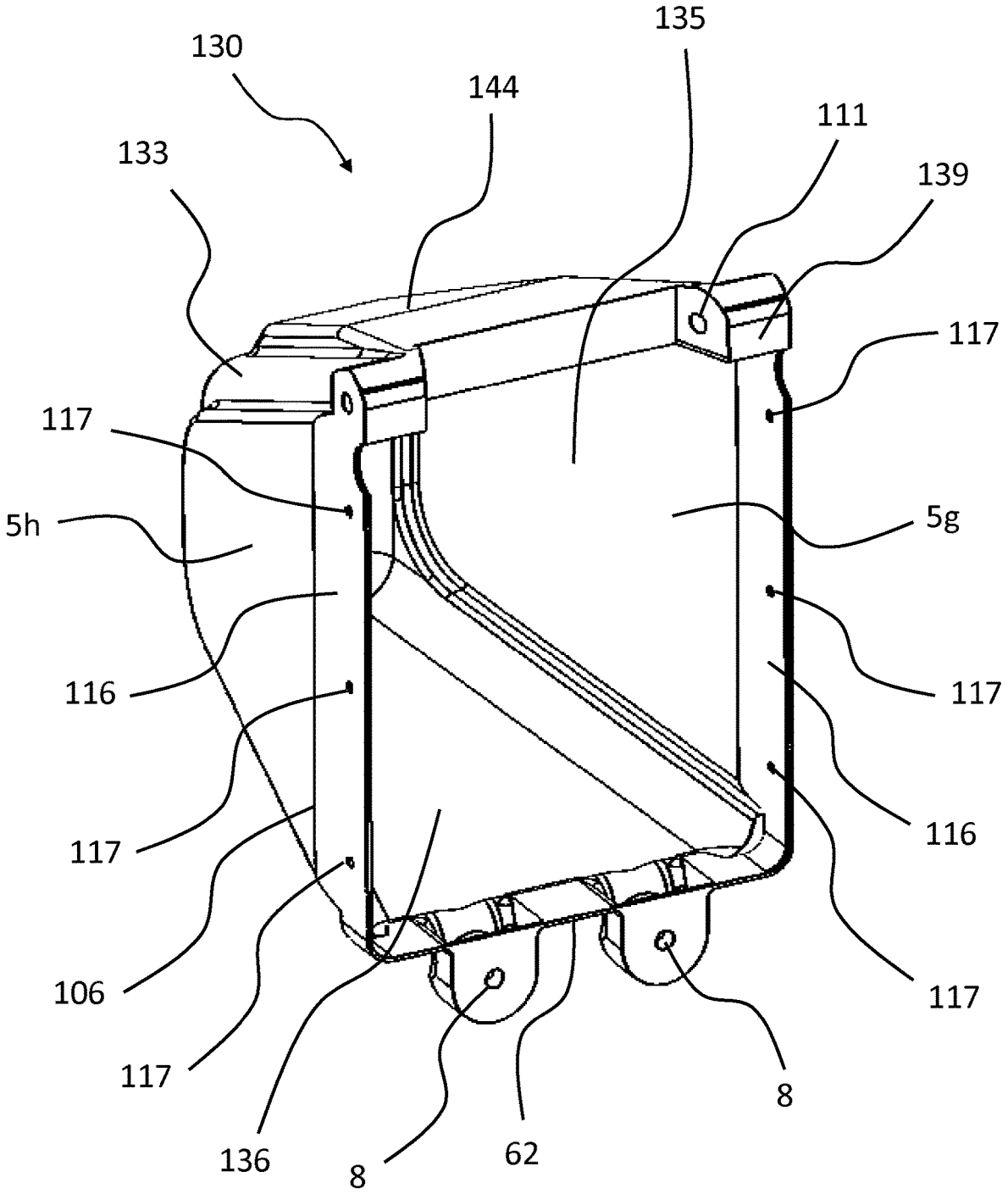
FIG. 14 is perspective view of a back of the security bulwark shown in FIG. 13.
Figure 15:
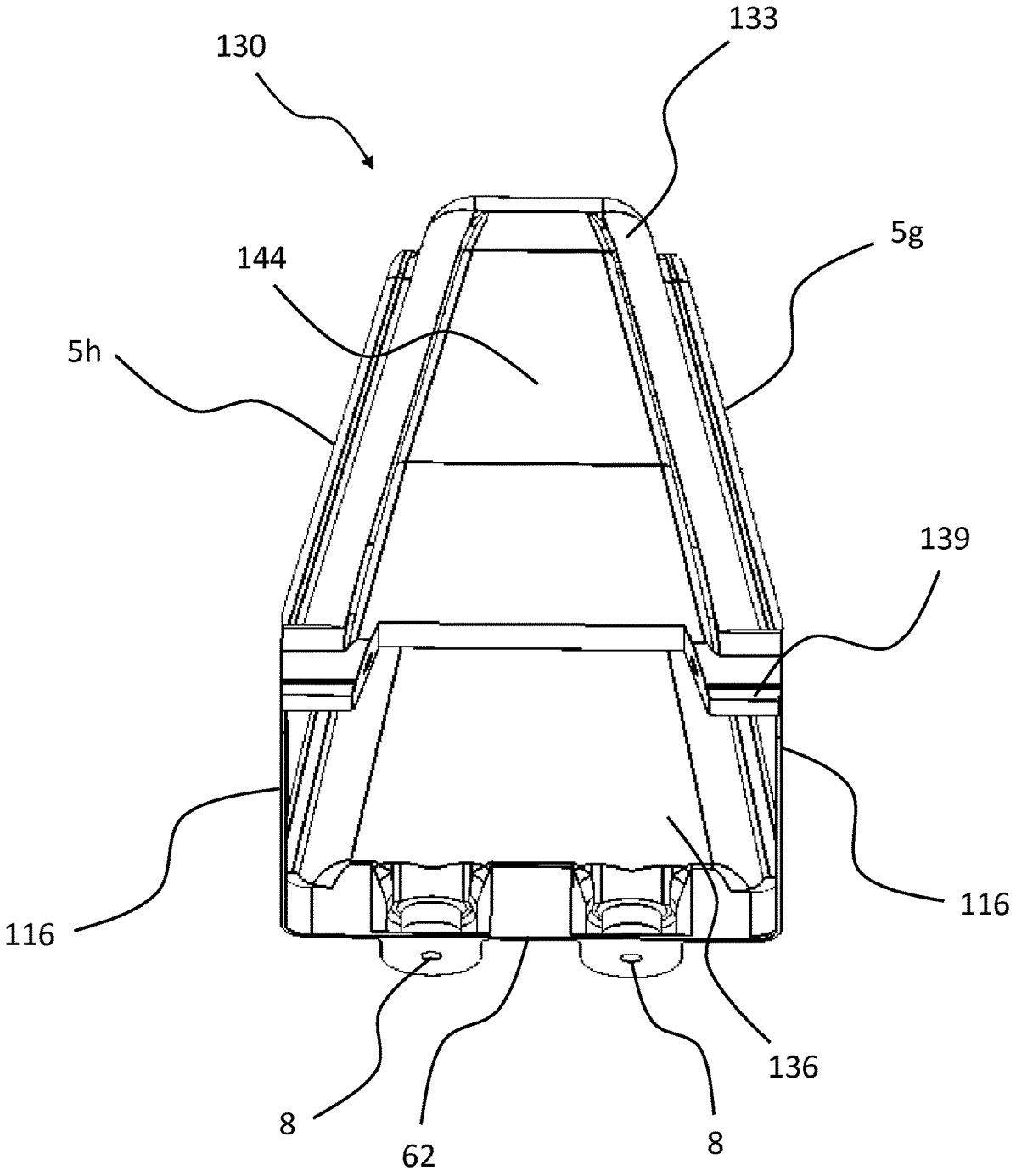
FIG. 15 is a perspective view from behind and above of the security bulwark shown in FIGS. 13 and 14.

FIGS. 13 to 15 are three different views of a fourth embodiment of a security bulwark 130 for mounting outside a perimeter railing of a vessel or marine installation. The bulwark 130 has a pair of side faces 116, which are oriented substantially parallel to each other and which each have a front edge 106. The front edges 106 of the two side faces 116 together define a front face of the bulwark 130, which is perpendicular to the side faces 116. The front face of the bulwark 130 comprises a projecting mound 133. The mound 133 rises directly from the front edge 106 of each side face 116. The mound 133 has an underside 134, which provides the bulwark 130 with an overhang, and is convex in a direction A-A' of the breadth of the bulwark. The mound 133 also has a pair of side surfaces 5*g*, 5*h* which are angled at between 60 and 82 degrees to the front face of the bulwark 130, that is to say, at between 120 and 98 degrees to a respective one of the side faces 116. As can best be seen from FIG. 15, the side surfaces 5*g*, 5*h* of the mound 133 are both substantially flat. The mound 133 projects more than 400 mm out from the front face of the bulwark 130, and is not more than 300 mm wide at its furthest projection from the front face of the bulwark 130, that is to say, from where the mound 133 meets the side faces 116 of the bulwark 130 at their front edges 106.

Each of the side faces 116 comprises a plurality of connection sites 137 for connecting the security bulwark 130 to an adjacent security bulwark. The connection sites 137 each comprise a through-hole formed in one of the side faces 116 of the bulwark 130 and which is able to receive a connector 18, such as a bolt. The bulwark 130 further comprises two boreholes 111, which are longitudinally aligned with each other and run in the direction A-A' of the breadth of the bulwark 130, alongside an uppermost edge 112 of the bulwark 130. These boreholes 111 are each able to receive a rod therein in the direction A-A'. Like the security bulwark 30 shown in FIGS. 5 to 7, the security bulwark 130 has a pair of eyelets 8 formed through the front face of the bulwark 130.

The security bulwark 130 also has dimensions similar to those of the security bulwark 30 shown in FIGS. 5 to 7. Thus all of the gaps between the courses of rails in a railing to which the bulwark 130 is mounted, from the lowest course of rails to the topmost handrail, are at least partially covered by the bulwark 130, whilst still leaving an opening between a lowermost edge 62 of the bulwark and the deck, to allow seawater from waves which break on to the deck to wash back over the edge of the vessel or marine installation into the sea. The bulwark 130 is thus also sufficiently small for one person to be able to handle it with ease.

As may best be seen in FIG. 14, the security bulwark 130 has a back 139 opposite to the front face of the bulwark 130. The back 139 comprises a recess 136 which is formed by an interior surface 135 of the projecting mound 133. The mound 133 further comprises a raised crest 144 adapting the recess 136 to receive the corner of a perimeter railing. Thus the bulwark 130 may be mounted not only along a straight run of perimeter railing, but also at a corner thereof. The recess 136 is also able to receive the mound 133 on the front face of a similar bulwark 130, whereby two or more such bulwarks 130 can be nested together in a similar manner to that shown in FIG. 4 for the bulwark 1.

Figure 16:
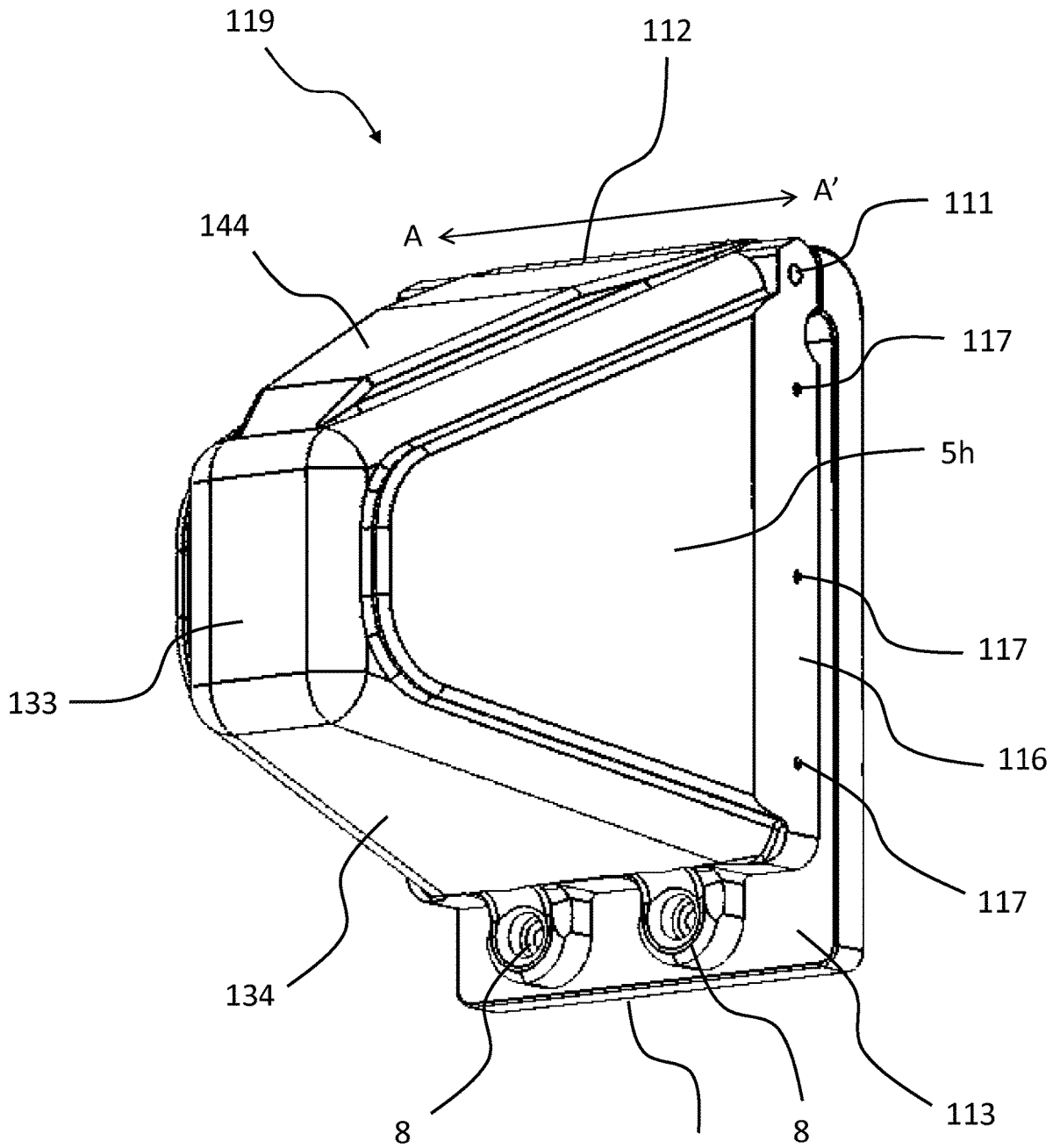
FIG. 16 is a first perspective view of a front face of a fifth embodiment of a security bulwark.
Figure 17:
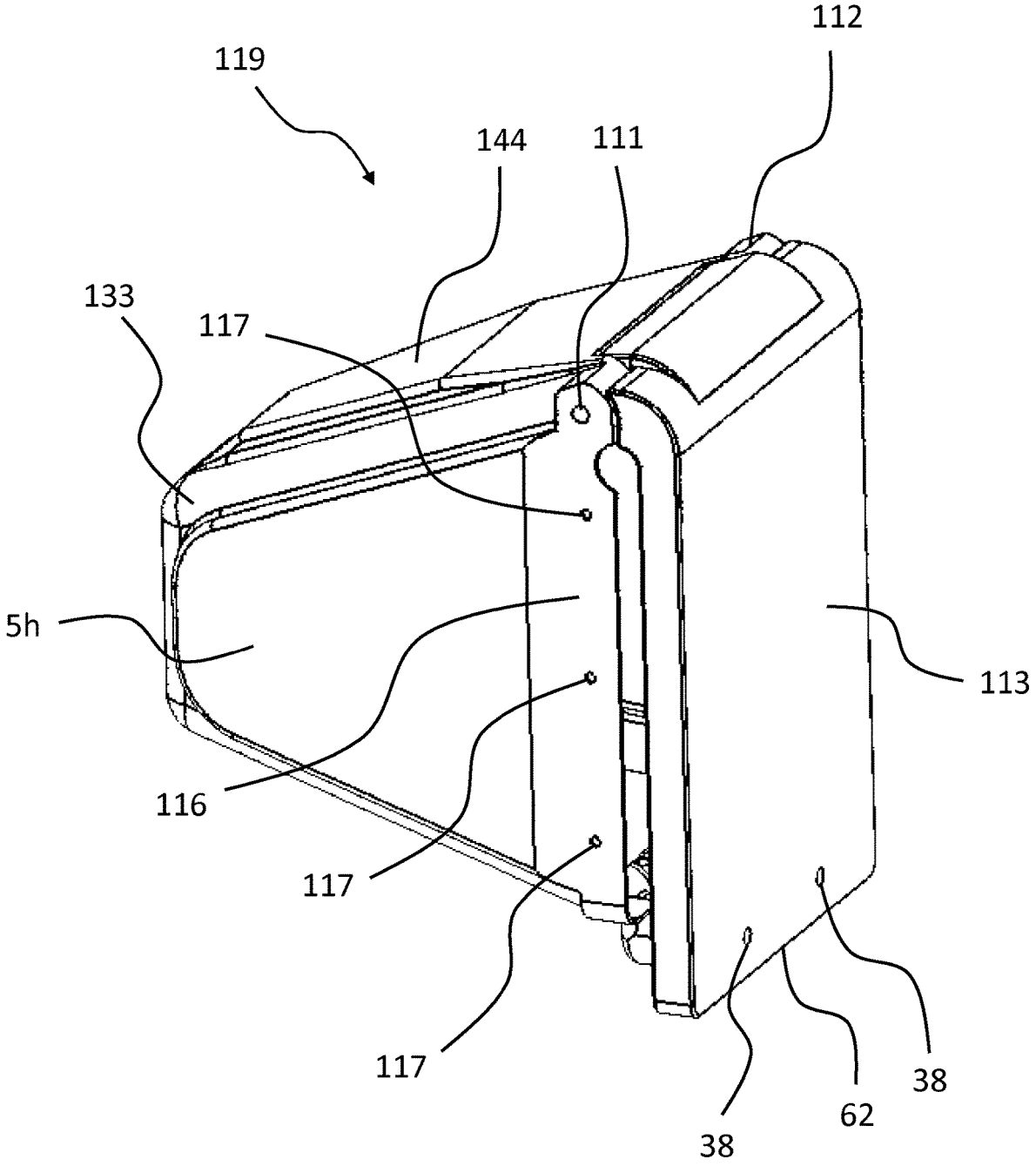
FIG. 17 is a perspective view of the back of the security bulwark shown in FIG. 16.
Figure 18:
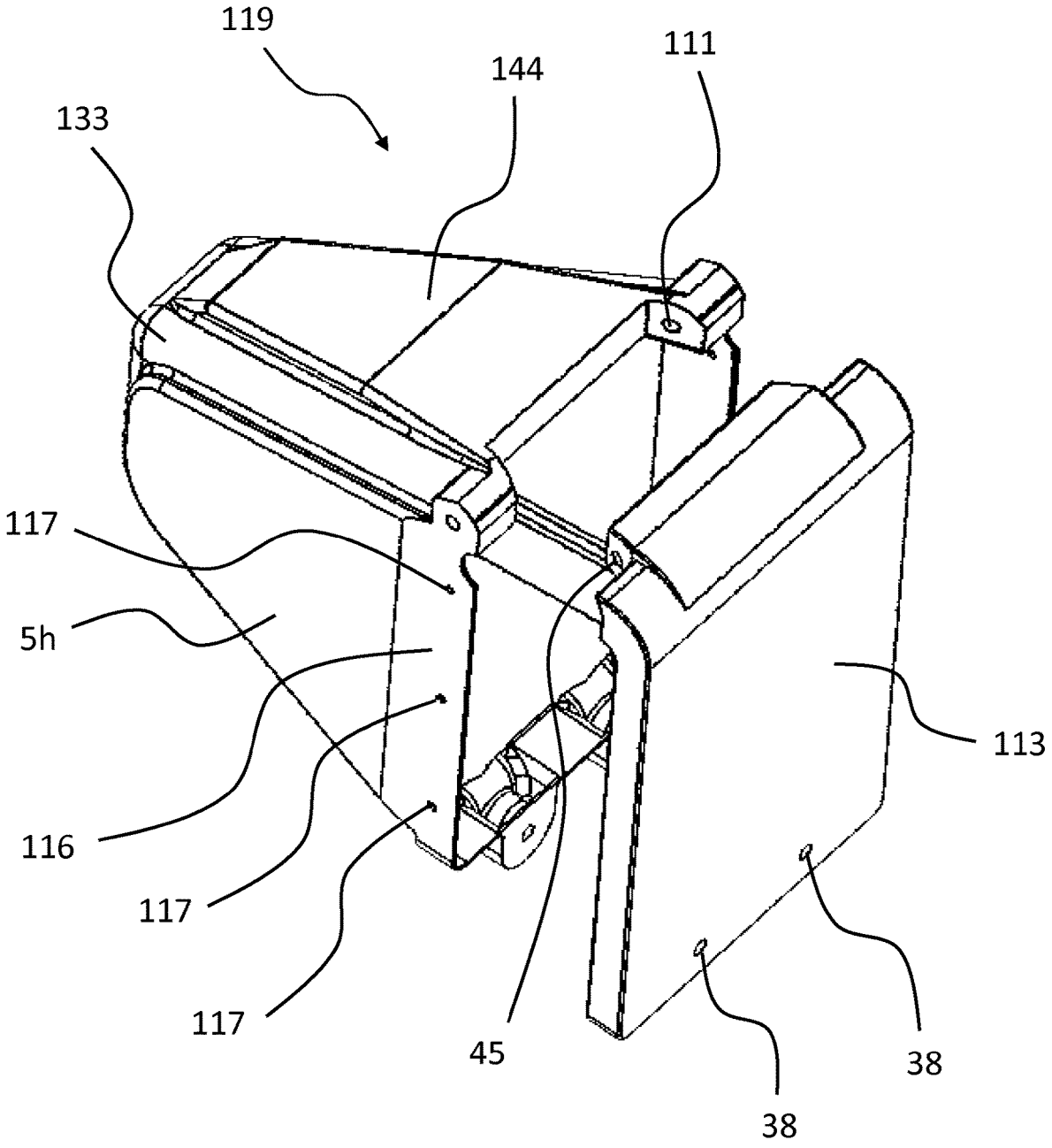
FIG. 18 is an exploded perspective view of the security bulwark shown in FIGS. 16 and 17.

FIGS. 16 to 18 are three different views of a fifth embodiment of a security bulwark 119 for mounting along a perimeter railing of a vessel or marine installation. The security bulwark 119 has a front face and two sides 116, all of which are the same as those of the security bulwark 130 shown in FIGS. 13 to 15 and comprise the same features. The security bulwark 119 differs from the security bulwark 130, however, in that it further comprises a rear panel 113 on the back 139 thereof for mounting inside a perimeter railing of a vessel or marine installation. The rear panel 113 is shown in more detail in FIGS. 19 and 20. As may best be seen in FIG. 19, the rear panel 113 comprises a borehole 45, which is located between and longitudinally aligned with the two boreholes 111 described above in relation to the security bulwark 130. Like the two boreholes 111, the borehole 45 also runs in the direction A-A' of the breadth of the bulwark 119, alongside an uppermost edge 112 of the bulwark 119. Thus a rod can be inserted into a first one of the two boreholes 111, through the borehole 45 in the rear panel 113 and then into a second one of the two boreholes 111, so that the rear panel 113 can be hinged relative to the front face of the bulwark 119 substantially parallel to the uppermost edge 112 of the bulwark 119 by rotation about the rod. Moreover, the rod is removable from the boreholes 111, 45, so that the rear panel 113 can be detached from the rest of the bulwark 119.

As may best be seen in the exploded view of FIG. 18, however, even when the rear panel 113 is attached to the rest of the bulwark 119 via such a rod, the shape of the rear panel 113 is such that the rear panel 113 can adopt a position in which it is parallel to but spaced apart from the front face of the security bulwark 119. The separation of the rear panel 113 from the front face in this position is sufficiently great to accommodate the thickness of any perimeter railing generally found on a vessel or marine installation. Thus the rear panel 113 can be hinged apart from the front face of the bulwark 119, and the bulwark 119 can be mounted over a perimeter railing, with the front face disposed on the outside or seaward side of the railing and the rear panel 113 on the inside or deck side of the railing. The rear panel 113 and the rest of the bulwark 119 can then be hinged back together until the rear panel 113 is parallel to but spaced apart from the front face of the security bulwark 119 once again. In this position, a lowermost edge 62 of the rear panel 113 aligns with the lowermost part of the front face of the security bulwark 119, which includes the pair of eyelets 8, so that the overall height of the security bulwark 119 is the same as that of the security bulwark 1.

Figure 19:
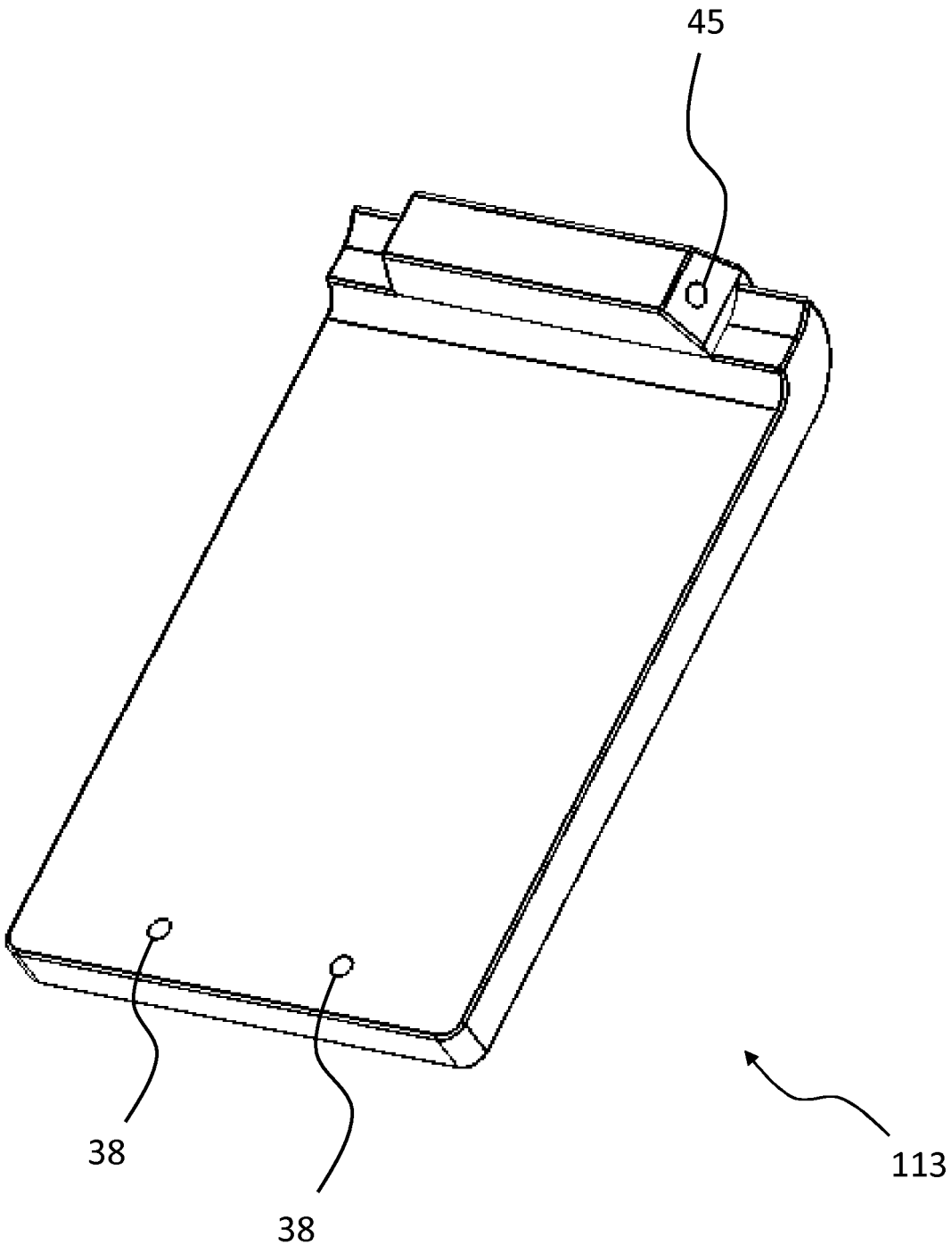
FIG. 19 is a first perspective view of a rear panel of the security bulwark shown in FIGS. 16 to 18.
Figure 20:
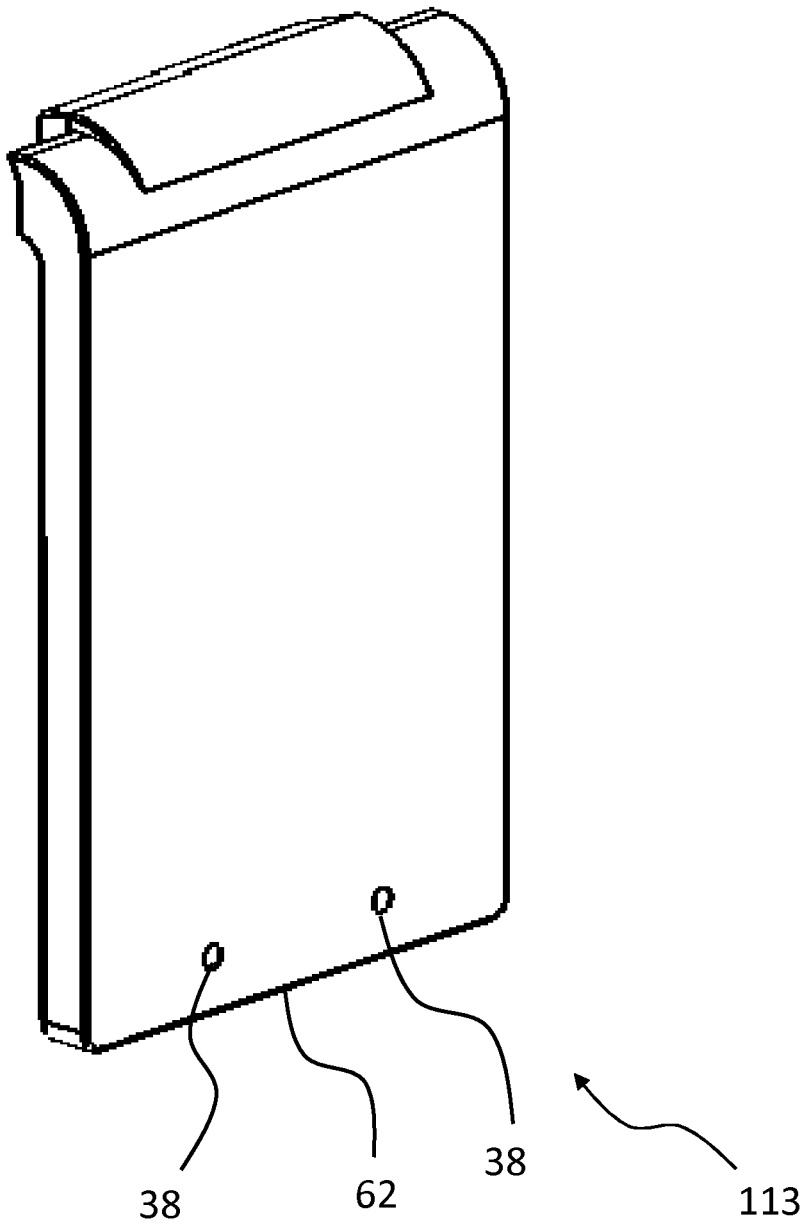
FIG. 20 is a second perspective view of the rear panel shown in FIG. 19.

As can be seen in FIGS. 19 and 20, the rear panel 113 comprises a pair of connection sites 38, for connecting the rear panel 113 to the front face of the security bulwark 119. The connection sites 38 each comprise a through-hole formed in the rear panel 113 which is able to receive a connector, such as a bolt. The locations of the connection sites 38 on the rear panel 113 correspond to the locations of the eyelets 8 on the front face of the security bulwark 119. Thus once the bulwark 119 has been mounted over a perimeter railing, a connector, such as a bolt, can be inserted into a through-hole at one of the connection sites 38 on the rear panel 113 and through the corresponding one of the eyelets 8 on the front panel, in a direction perpendicular to the perimeter railing over which the bulwark 119 has been mounted. The bolt can then be fitted with a nut, for example, and both can be tightened together until the rear panel 113 and the front face are secured together, thereby preventing the security bulwark 119 from being removed from the perimeter railing to which it has been mounted without firstly undoing the connector.

As may also be seen from FIGS. 19 and 20, the rear panel 113 differs from the rear panel 13 shown in FIGS. 11 and 12 in that it does not have any apertures or "cut-outs" for accommodating an obstruction in the way of a railing. Thus the rear panel 113 completely covers the recess 136 in the back 139 of the security bulwark 119, as can be seen in FIGS. 16 and 17. This means that if two such security bulwarks 119 are mounted side-by-side adjacent to each other over a perimeter railing, one of the rear panels 113 on a first one of the two adjacent security bulwarks 119 will be adjacent to another such rear panel 113 on the other of the two adjacent security bulwarks 119, whereby a continuous wall maybe formed on the inside or deck side of the perimeter railing.

Figure 21:
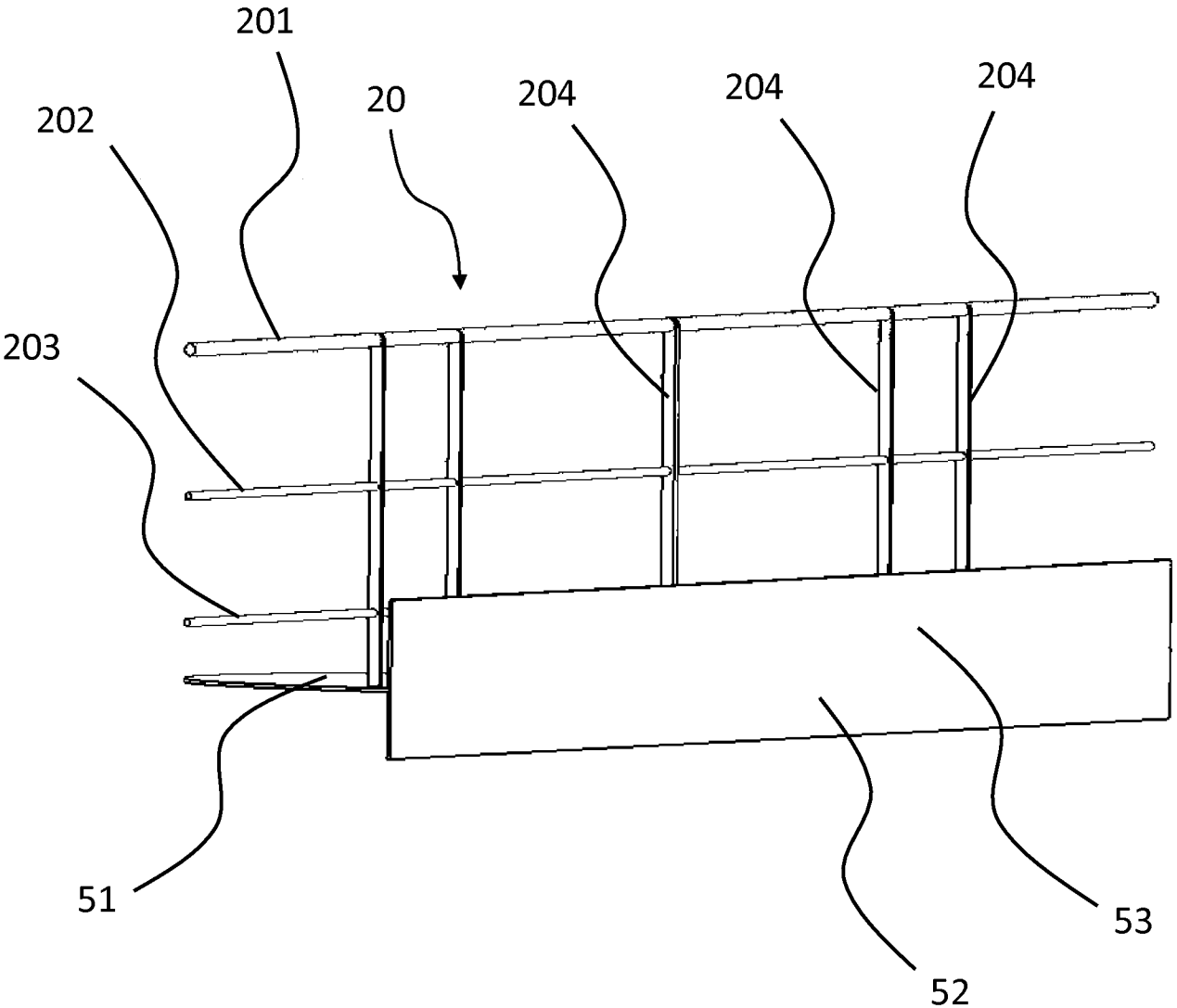
FIG. 21 is a perspective view from an outside or seaward side of a part of a perimeter railing of a vessel or marine installation.
Figure 22:
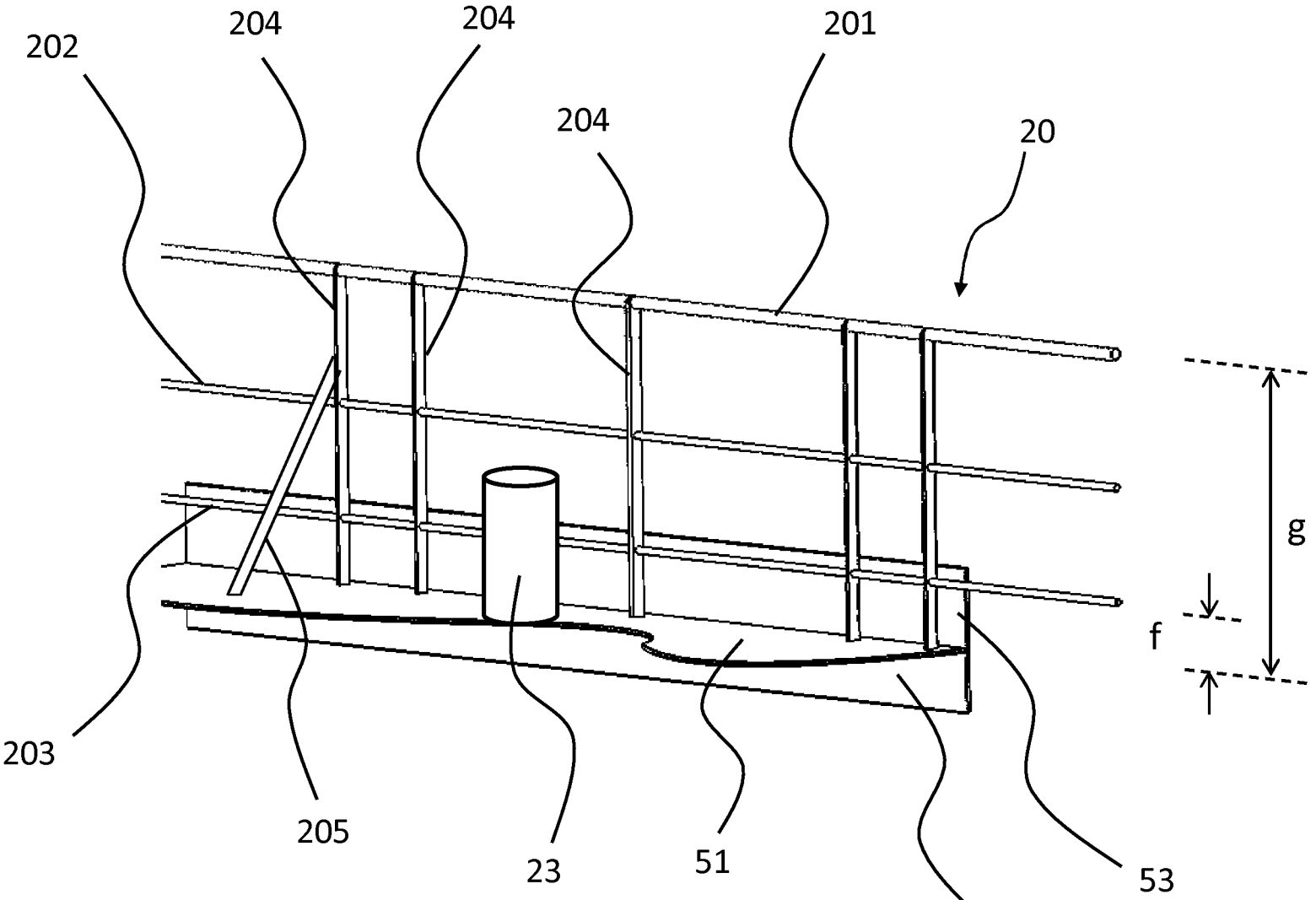
FIG. 22 is a perspective view from an inside or deck side of the part of a perimeter railing shown in FIG. 21.

FIGS. 21 and 22 respectively show views from an outside or seaward side and from an inside or deck side of a representative part of a perimeter railing 20 of a vessel or marine installation. Part of a side of the vessel or marine installation can be seen labelled with reference numeral 52. The perimeter railing 20 comprises a plurality of courses of rails, which include a topmost handrail 201, a middle course of rails 202 and a lowest course of rails 203. At regular intervals along the perimeter railing 20 are a plurality of vertical stanchions 204. Regulations require that the vertical stanchions 204 are spaced no more than 1.5 metres apart. The perimeter railing 20 is mounted on a deck 51 of the vessel or marine installation. The overall height, g, of the railing 20 from the deck 51 to the topmost handrail 201 is required by regulations to be at least 1 metre. The separation, f, of the lowest course of rails 203 from the deck 51 is also required by regulations to be no more than 230 mm. The middle course of rails 202 is positioned approximately equidistant between the topmost handrail 201 and the lowest course of rails 203. Thus a gap between the topmost handrail 201 and the middle course of rails 202 or between the middle course of rails 202 and the lowest course of rails 203 is given by (g−f)/2, from which must also be subtracted the thickness of the courses of rails themselves. Each gap is therefore usually not more than 500 mm in height, and, in practice, is considerably less than this. Outside the railing 20 at the edge of the deck 51 is a vertical lip called a fishplate 53, the height of which depends upon the type of vessel or marine installation on which the railing 20 is mounted, but which, in general, is between about 90 and about 400 mm in height.

The perimeter railing 20 is upheld at regular intervals by a plurality of support stays 205, one of which may be seen in FIG. 22. Regulations require that there must be as a minimum of one support stay 205 for every three vertical stanchions 204, although it is common for there to be a support stay 205 for every other stanchion 204. Also shown in FIG. 22 is a representative example of another obstruction 23 located on the inside or deck side of the railing 20.

Figure 23:
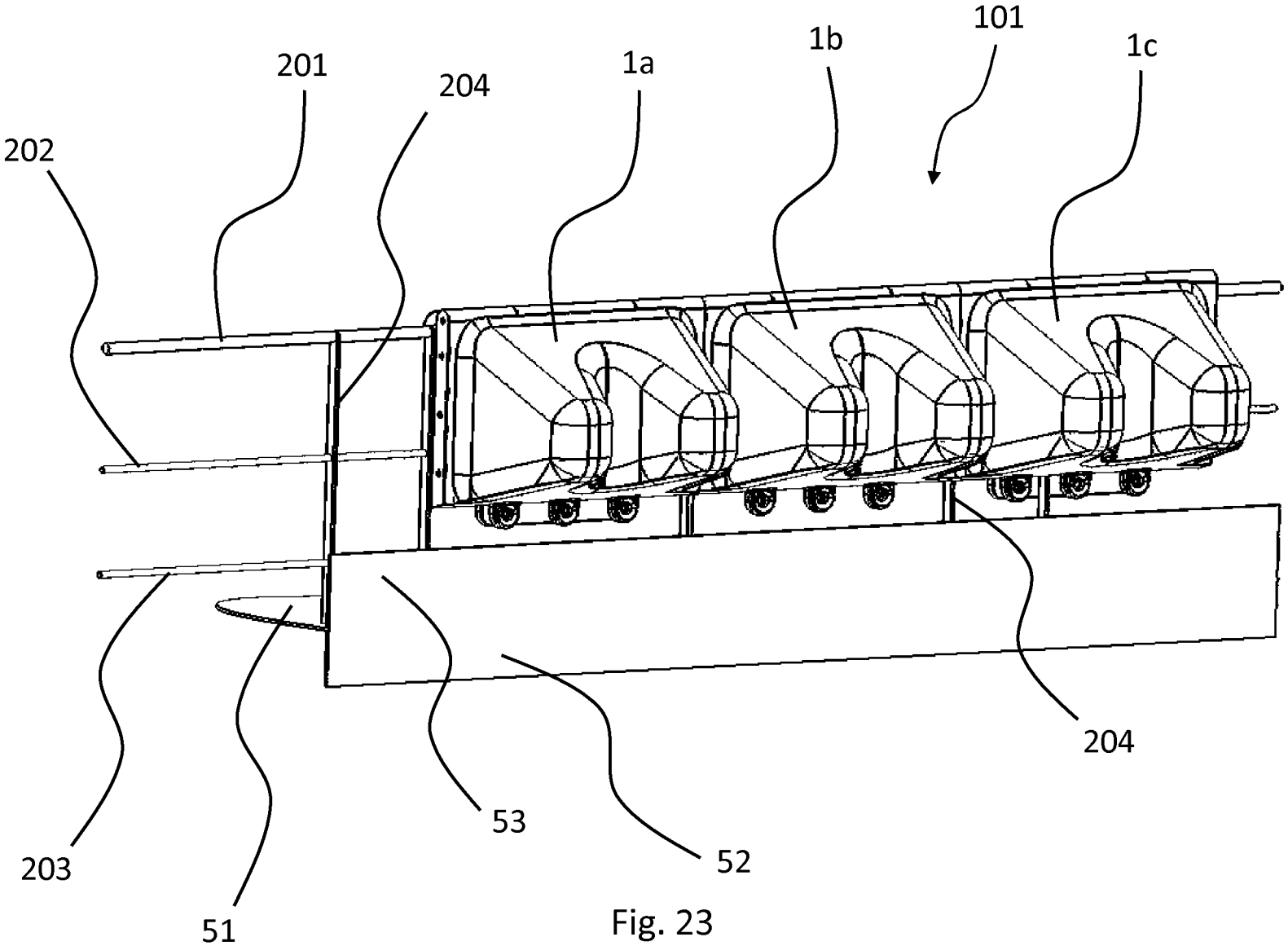
FIG. 23 is a perspective view from an outside or seaward side of a first embodiment of a perimeter protection system.
Figure 24:
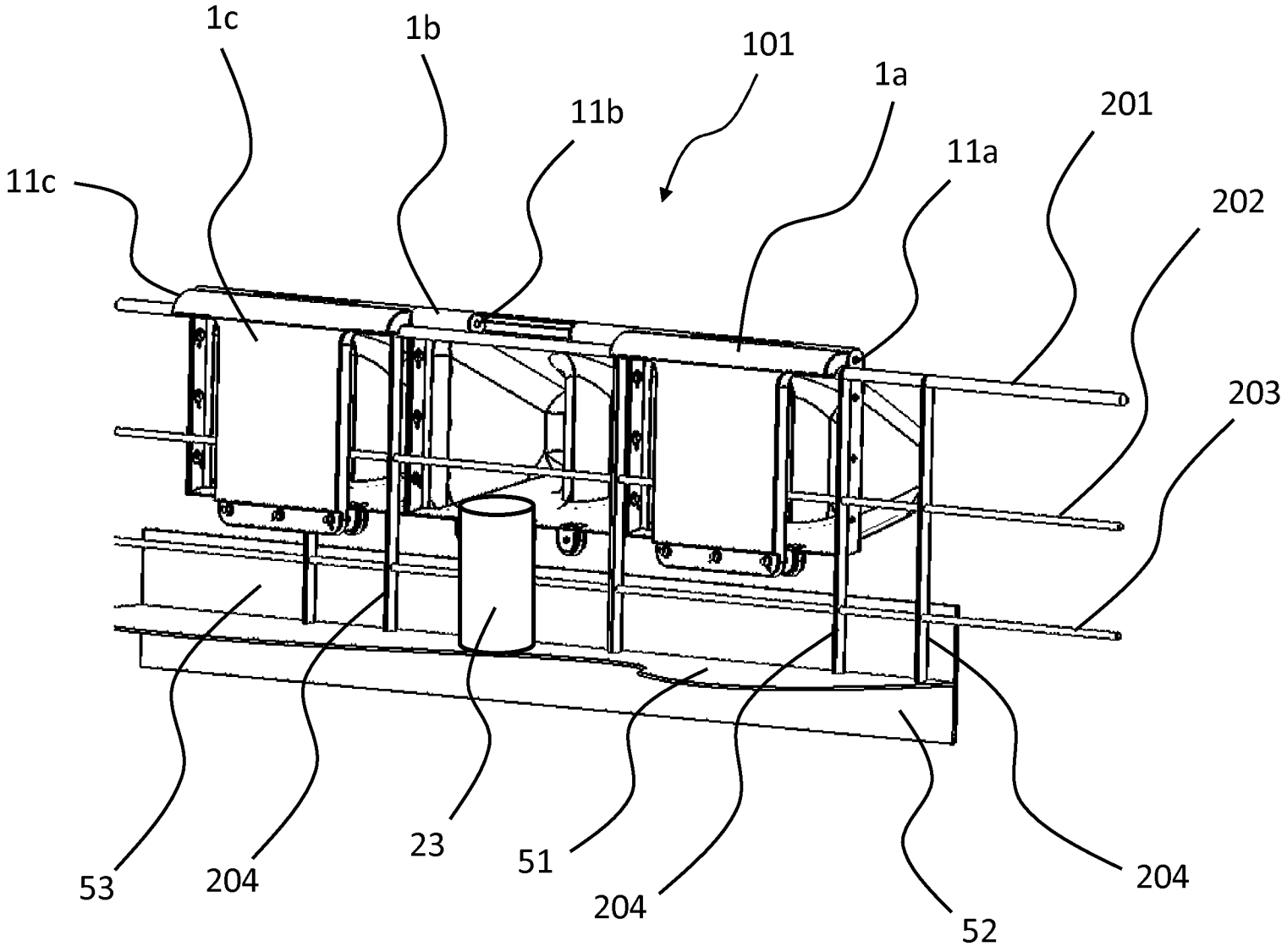
FIG. 24 is a perspective view from an inside or deck side of the perimeter protection system shown in FIG. 23.

FIGS. 23 and 24 respectively show views from an outside or seaward side and from an inside or deck side of a representative part of a first embodiment of a perimeter protection system 101 mounted along a perimeter railing 20 of a vessel or marine installation. The perimeter protection system 101 comprises a plurality of security bulwarks 1*a*, 1*b*, 1*c* arranged side-by-side adjacent to each other. A leftmost one 1*a* and a rightmost one 1*c* of the three adjacent security bulwarks are both of the type described above in relation to FIGS. 8 to 12. A central one 1*b* of the three adjacent security bulwarks is of the type described above in relation to FIGS. 1 to 3. The adjacent security bulwarks 1*a*, 1*b*, 1*c* abut each other and are attached together at the respective connection sites 17 on the side faces 16 thereof by a plurality of respective connectors 18. The attachment of the three adjacent security bulwarks 1*a*, 1*b*, 1*c* to each other can be strengthened further by passing a rod 15 through the borehole 11*b* of the central security bulwark 1*b* and into at least one of the respective boreholes 11*a*, 11*c* of the leftmost and rightmost security bulwarks 1*a*, 1*c*.

Thus whereas the leftmost and rightmost security bulwarks 1*a*, 1*c* are mounted over the perimeter railing 20, so that the railing 20 bears the weight of each such bulwark 1*a*, 1*c*, the central security bulwark 1*b* is only mounted outside the perimeter railing 20, that is to say, just on the seaward side of the railing, and without the weight of the central security bulwark 1*b* bearing directly down on the perimeter railing 20. Instead, the central security bulwark 1*b* is suspended from the leftmost and rightmost security bulwarks 1*a*, 1*c* via the connectors 18. Since the central security bulwark 1*b* is only mounted outside the perimeter railing 20, this allows it to be positioned along the railing 20 where the obstruction 23 is located on the inside or deck side of the railing 20, as shown in FIG. 24. However, since the weight of the central security bulwark 1*b* is distributed to the leftmost and rightmost security bulwarks 1*a*, 1*c* by being suspended from them via the connectors 18, this would alternatively also allow the central security bulwark 1*b* to be positioned across a gap in the railing spanned by a freely hanging chain, which is therefore not rigid enough to support the weight of a security bulwark.

Figure 25:
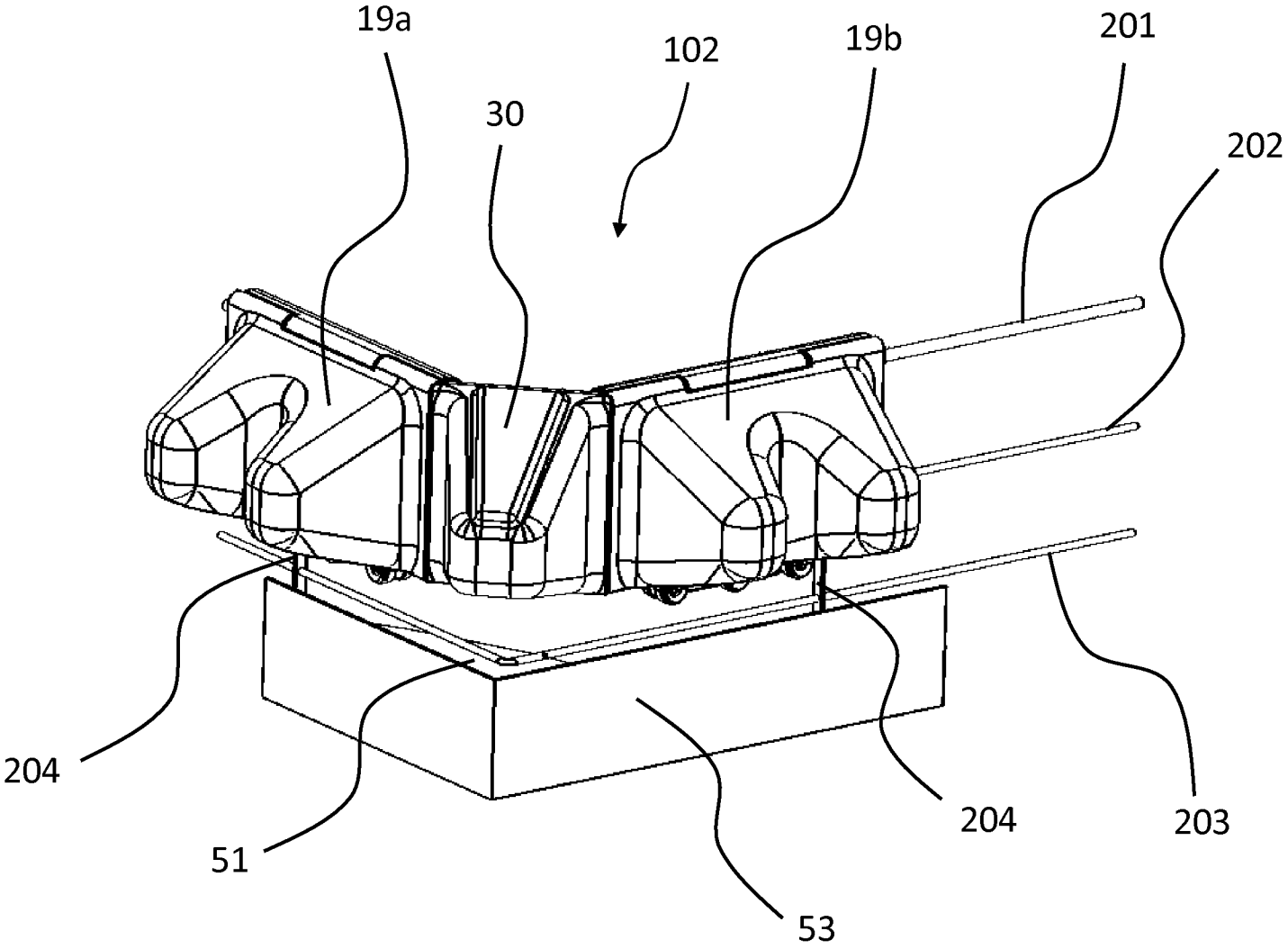
FIG. 25 is a perspective view from an outside or seaward side of a second embodiment of a perimeter protection system.
Figure 26:
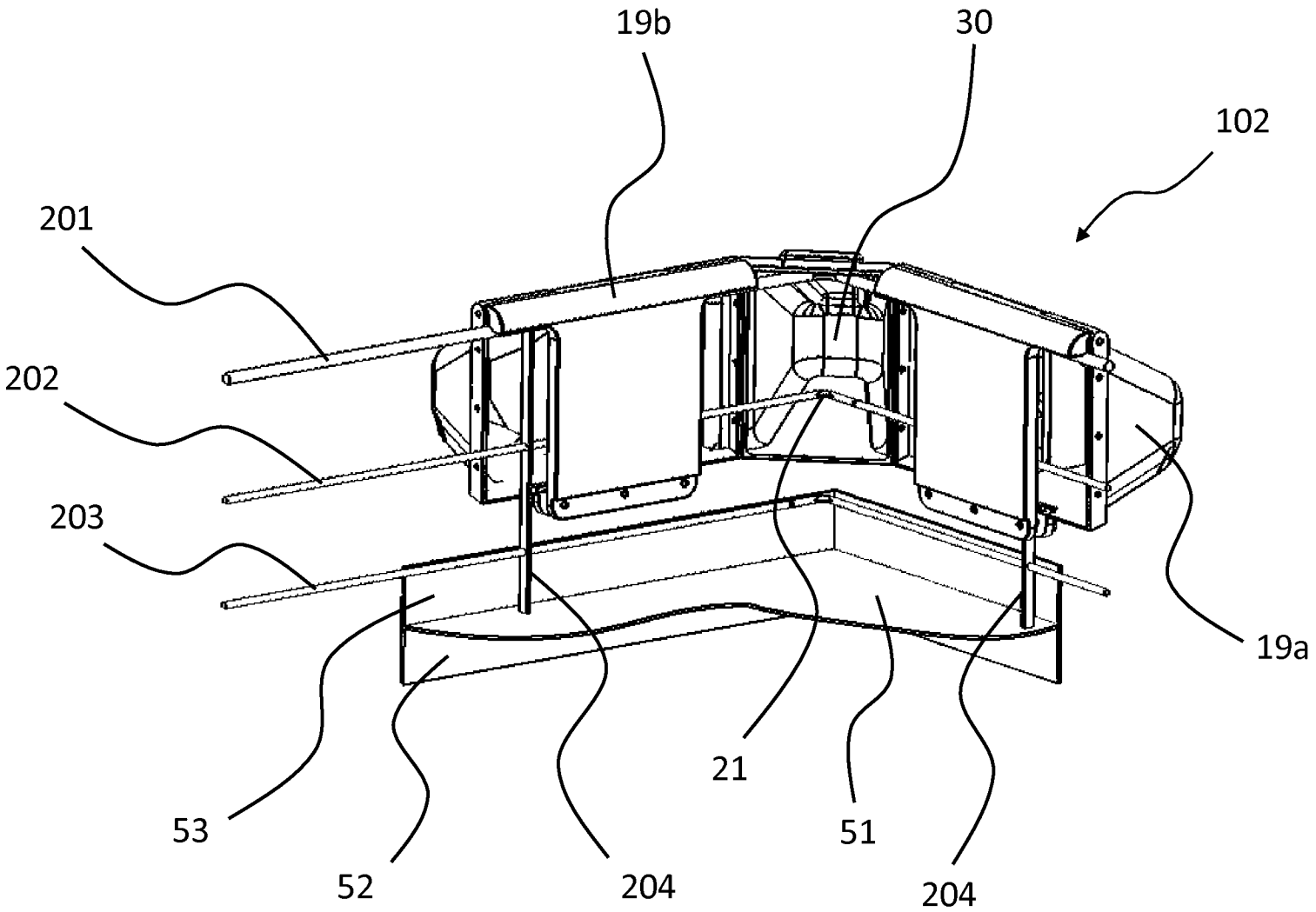
FIG. 26 is a perspective view from an inside or deck side of the perimeter protection system shown in FIG. 25.

FIGS. 25 and 26 respectively show views from the outside or seaward side and from the inside or deck side of a part of an embodiment of a perimeter protection system 102 in the region of a corner 21 of a perimeter railing 20 of a vessel or marine installation. The perimeter protection system 102 comprises a plurality of security bulwarks 19*a*, 19*b*, 30 arranged side-by-side adjacent to each other, which continue along the perimeter railing 20 beyond the part of the perimeter protection system 102 at the corner 21, which is shown in FIGS. 25 and 26. The plurality of security bulwarks comprises two security bulwarks 19*a*, 19*b* of the type shown in FIGS. 8 to 12 and a security bulwark 30 as shown in FIGS. 5 to 7. The two security bulwarks 19*a*, 19*b* are each positioned along substantially straight runs of the perimeter railing 20 which meet at the corner 21. The security bulwark 30 is located at the corner 21 of the perimeter railing 20. Thus the security bulwark 30 is located between and adjacent to each of the two security bulwarks 19*a*, 19*b*.

Since the left side 31L and the right side 31R of the security bulwark 30 are oriented substantially perpendicular to each other, each of the left and right sides 31L, 31R can be aligned parallel to and in abutment with a respective one of the sides 16 of the security bulwarks 19*a*, 19*b*. The left and right sides 31L, 31R of the security bulwark 30 can then be connected to the respective sides 16 of the security bulwarks 19*a*, 19*b* via respective connectors 18. Thus whereas the two security bulwarks 19*a*, 19*b* are mounted over the perimeter railing 20, so that the railing 20 bears the weight of each such bulwark 19*a*, 19*b*, the security bulwark 30 is only mounted outside the perimeter railing 20, that is to say, just on the seaward side of the railing, and without the weight of the security bulwark 30 bearing directly down on the perimeter railing 20. Instead, the security bulwark 30 is suspended from the two security bulwarks 19*a*, 19*b* via the connectors 18. Since the security bulwark 30 is suspended from the two security bulwarks 19*a*, 19*b*, this allows it to be positioned at the corner 21 of the railing 20 without any need to attach the security bulwark 30 to the perimeter railing 20, as can be seen in FIG. 26.

Figure 27:
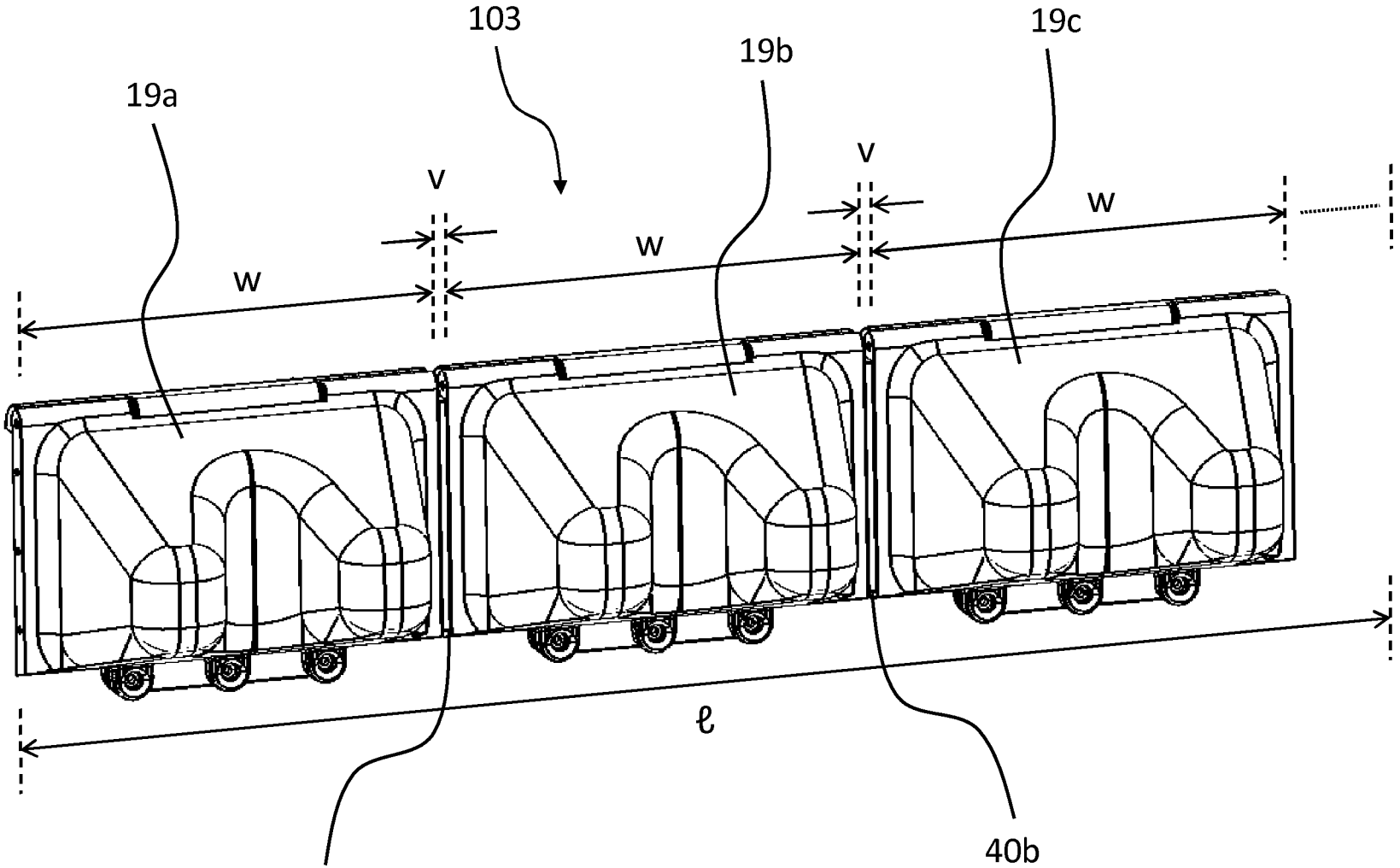
FIG. 27 is a perspective view from an outside or seaward side of a third embodiment of a perimeter protection system.
Figure 28:
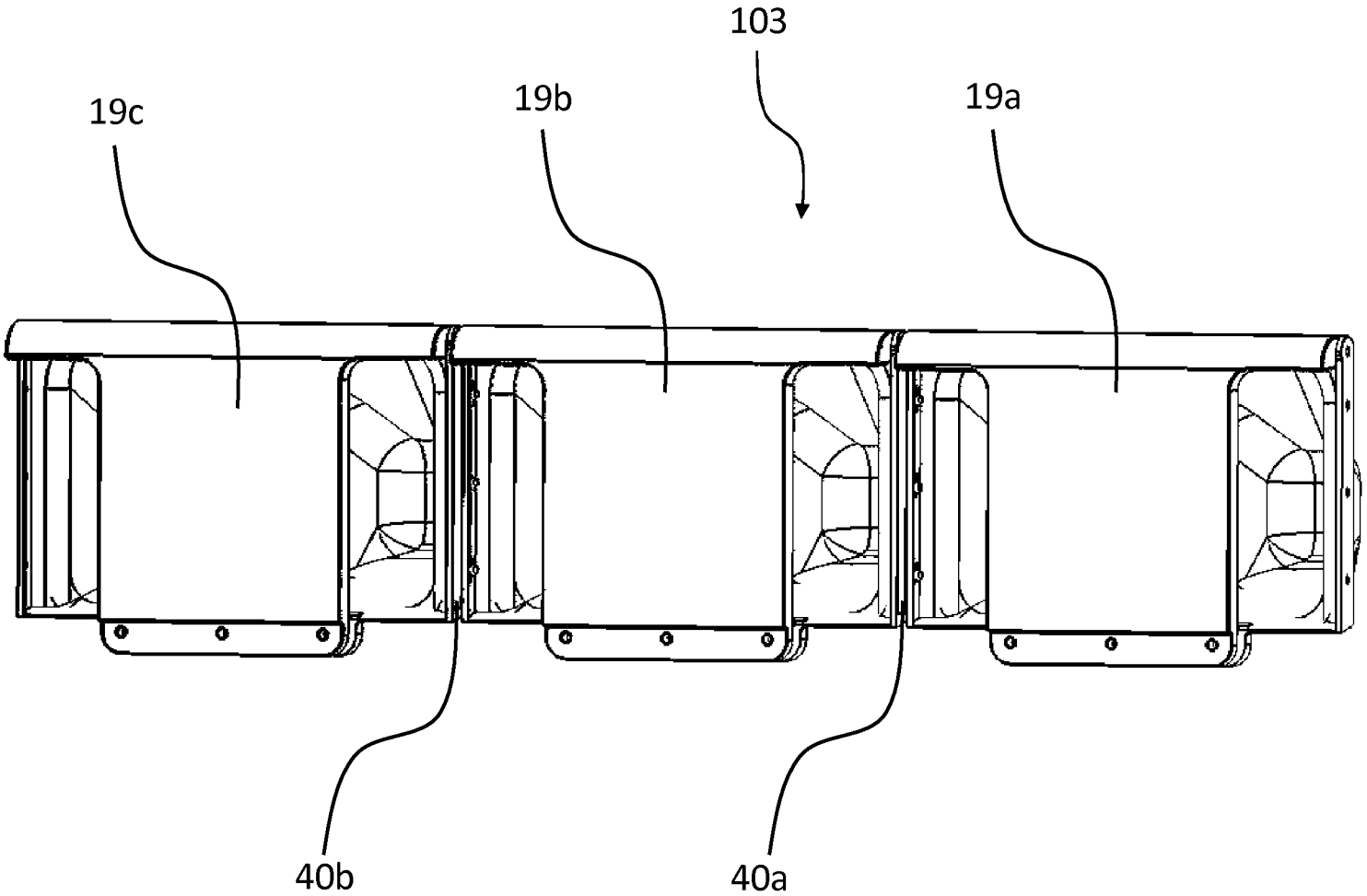
FIG. 28 is a perspective view from an inside or deck side of the perimeter protection system shown in FIG. 27.

FIGS. 27 and 28 respectively show views from an outside or seaward side and from an inside or deck side of a representative part of a third embodiment of a perimeter protection system 103 suitable for mounting along a perimeter railing of a vessel or marine installation. The perimeter protection system 103 comprises a first plurality, a, of security bulwarks 19*a*, 19*b*, 19*c* of the type shown in FIGS. 8 to 12 arranged side-by-side adjacent to each other. The perimeter protection system 103 also comprises a second plurality, b, of spacers 40*a*, 40*b* positioned between and abutting each of an adjacent pair of the plurality of security bulwarks 19*a*, 19*b*, 19*c*. Each of the security bulwarks 19*a*, 19*b*, 19*c* has a first width, w. Each of the spacers 40*a*, 40*b* has a second width, v, which is a fraction of the first width, w, that is to say, substantially less than the width, w, of the security bulwark 1*a*.

The combined width, aw+bv, of the first plurality, a, of security bulwarks 19*a*, 19*b*, 19*c* and the second plurality, b, of spacers 40*a*, 40*b* can be made substantially equal to a length, e, of the perimeter railing by an appropriate choice of the respective numbers, a and b, of the security bulwarks and spacers. For example, suppose that the length, e, of the perimeter railing is 34.56 metres, the width, w, of each security bulwark is 1 metre, and the width, v, of each spacer is 25 mm. Then by choosing the number, a, of security bulwarks to be 34 and the number, b, of spacers to be 22, the combined width, aw+bv, of the security bulwarks and spacers is equal to (34×1)+(22×0.025)=34.55 metres, which is substantially equal to the length, l=34.56 metres, of the perimeter railing. The small difference of 34.56−34.55=0.01 metres (or just 10 mm) between the combined width of the security bulwarks and spacers on the one hand and the length of the perimeter railing on the other can be accommodated by some slight flexibility of the security bulwarks 19*a*, 19*b*, 19*c*, or by very small variations, each of less than 1 mm, in the separation of the adjacent pairs of security bulwarks.

Figure 29:
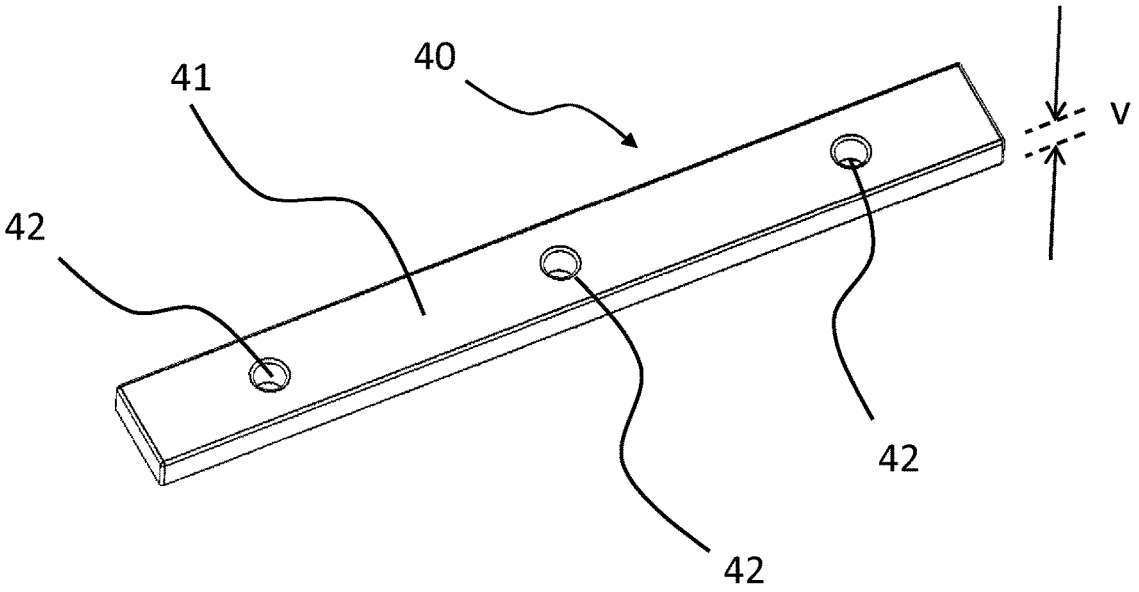
FIG. 29 is a first perspective view of a spacer of the perimeter protection system shown in FIGS. 27 and 28.
Figure 30:
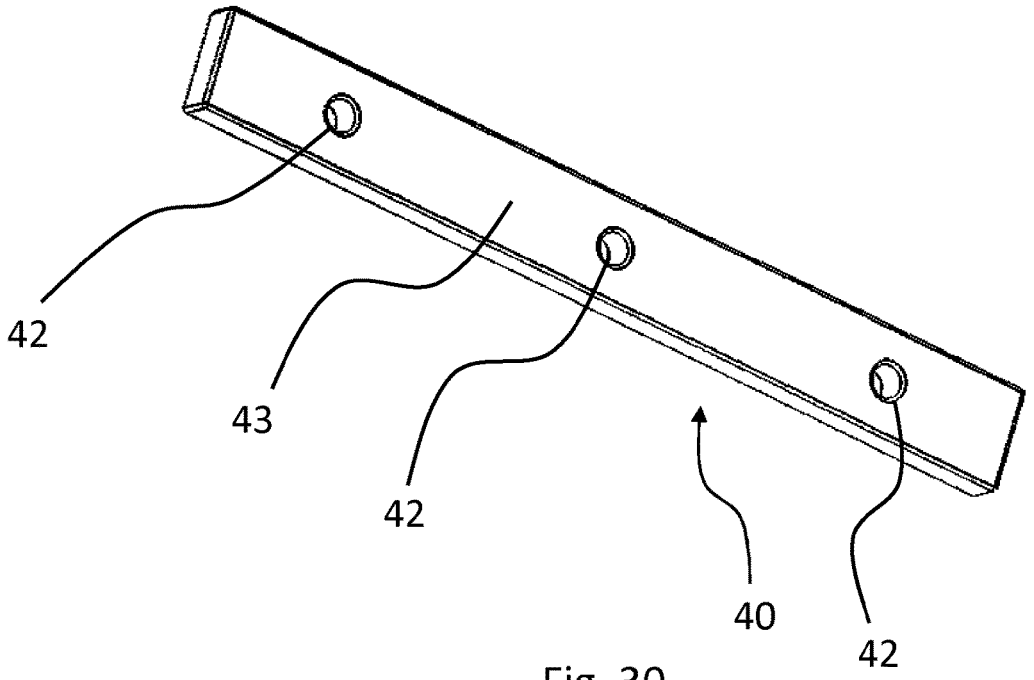
FIG. 30 is a second perspective view of the spacer shown in FIG. 29.

FIGS. 29 and 30 are two different views of a spacer 40 in the perimeter protection system 103 shown in FIGS. 27 and 28. The spacer 40 comprises a first side 41 and an opposing second side 43, both of which can be positioned abutting a respective one of the sides 16 of the security bulwark 1. As can be seen, the profile of the sides 41, 43 mirrors that of the sides 16 of the security bulwark 19. The spacer 40 also comprises a plurality of through-holes 42 from the first side 41 to the opposing second side 43 of the spacer 40. The locations of the through-holes 42 on the spacer 40 correspond to the locations of the connection sites 17 on the sides 16 of the security bulwarks 19. Thus if a pair of such security bulwarks 19 are arranged side-by-side adjacent to each other with one or more of the spacers 40 positioned between them, the through-holes 42 on the spacers 40 can be aligned with the connection sites 17 on the sides 16 of the security bulwarks 19. The adjacent pair of security bulwarks 19 can then be connected to each other via the respective through-holes 42 of the one or more spacers 40. For example, a connector 18, such as a bolt, can be inserted into a through-hole in the side 16 of a first one of the pair of security bulwarks 19, through the respective through-hole 42 of the one or more spacers 40 and out of a through-hole in the side 16 of the other one of the pair of security bulwarks 19, in a direction parallel with a perimeter railing to which the perimeter protection system 103 is mounted. The bolt can then be fitted with a nut, for example, and both can be tightened together until the adjacent pair of security bulwarks 19 and the one or more spacers 40 positioned between them abut each other. This allows for quick and easy connection of the adjacent pair of the security bulwarks 19 to each other via the one or more of the spacers 40 positioned between them, to form a strong and structurally sound security barrier comprising the adjacent pair of security bulwarks 19 and the one or more spacers 40.

Whereas the perimeter protection system 103 has been described above as comprising a plurality of security bulwarks 19*a*, 19*b*, 19*c* of the type shown in FIGS. 8 to 12, it could alternatively or additionally comprise one or more security bulwarks 1, 30 of the types respectively shown in FIGS. 1 to 3 and 5 to 7. In other words, the present invention envisages perimeter protection systems comprising any possible combination of the different types of security bulwarks 1, 19, 30 and spacer 40 described herein.

Figure 31:
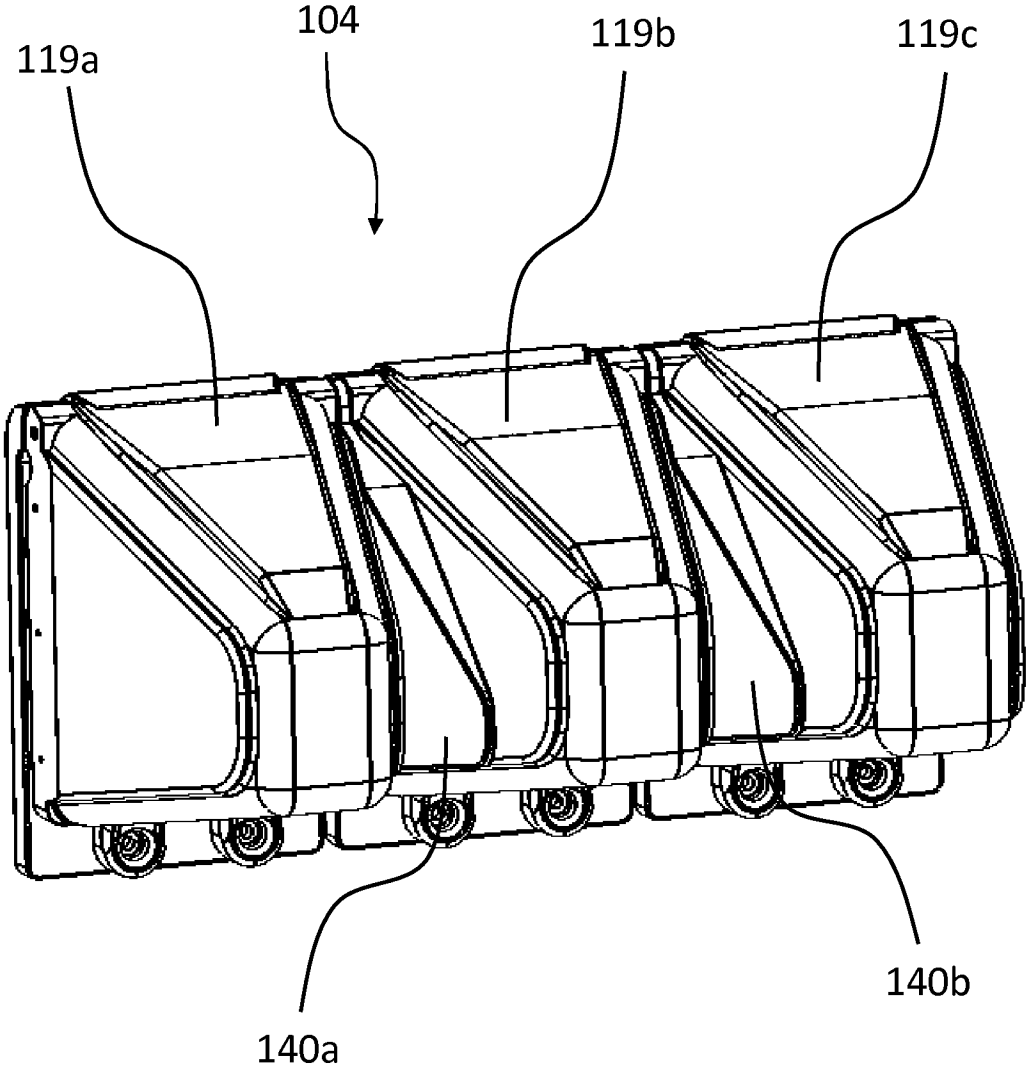
FIG. 31 is a perspective view from an outside or seaward side of a fourth embodiment of a perimeter protection system.
Figure 32:
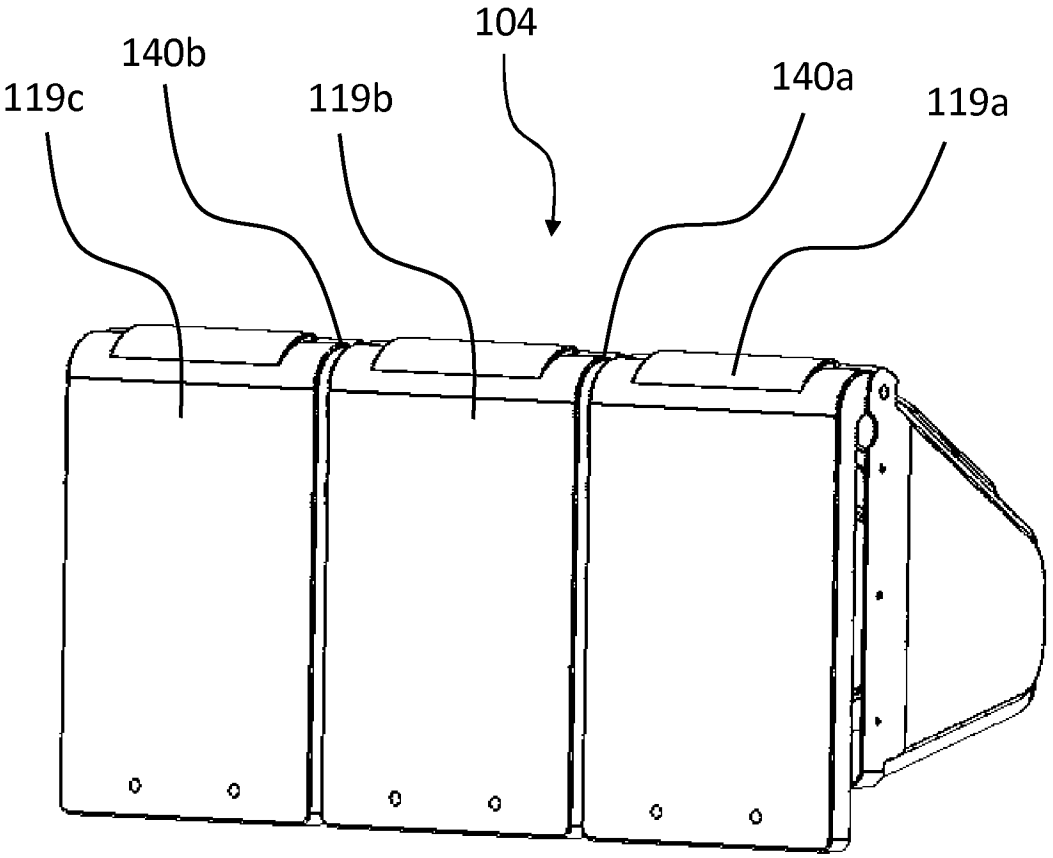
FIG. 32 is a perspective view from an inside or deck side of the perimeter protection system shown in FIG. 31.

FIGS. 31 and 32 respectively show views from an outside or seaward side and from an inside or deck side of a representative part of a fourth embodiment of a perimeter protection system 104 suitable for mounting along a perimeter railing of a vessel or marine installation.

The perimeter protection system 104 comprises a first plurality, a, of security bulwarks 119*a*, 119*b*, 119*c* of the type shown in FIGS. 16 to 20 arranged side-by-side adjacent to each other. The perimeter protection system 104 also comprises a second plurality, b, of spacers 140*a*, 140*b* positioned between and abutting each of an adjacent pair of the plurality of security bulwarks 119*a*, 119*b*, 119*c*.

Each of the security bulwarks 119*a*, 119*b*, 119*c* has a first width, w. Each of the spacers 140*a*, 140*b* has a second width, v, which is a fraction of the first width, w, that is to say, substantially less than the width, w, of the security bulwark 1*a*. The combined width, aw+bv, of the first plurality, a, of security bulwarks 119*a*, 119*b*, 119*c* and the second plurality, b, of spacers 140*a*, 140*b* can therefore be made substantially equal to a length, e, of the perimeter railing by an appropriate choice of the respective numbers, a and b, of the security bulwarks and spacers, in a similar manner to that described above in relation to FIGS. 27 and 28.

Moreover, whereas the perimeter protection system 104 is shown in FIGS. 31 and 32 to comprise only security bulwarks 119 of the type shown in FIGS. 16 to 20, any one of these security bulwarks 119 can be substituted by a similarly sized security bulwark 130 of the type shown in FIGS. 13 to 15. In such a manner, an obstruction in the way of a perimeter railing located on the deck side or inside of the railing can be accommodated by the perimeter protection system, by positioning a security bulwark 130 of the type shown in FIGS. 13 to 15 at the location of the obstruction. The perimeter protection system 104 may alternatively or additionally also comprise a security bulwark 30 of the type shown in FIGS. 5 to 7, whereby the perimeter protection system 104 can be extended around a corner of a perimeter railing on a vessel or marine installation. In other words, the present invention envisages perimeter protection systems comprising any possible combination of the different types of security bulwarks 30, 119, 130 and spacer 140 described herein.

Figure 33:
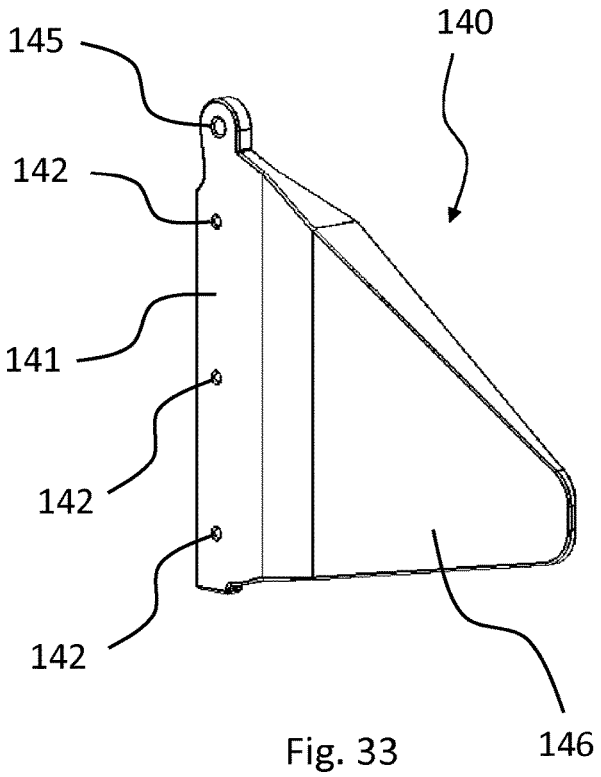
FIG. 33 is a first perspective view of a spacer of the perimeter protection system shown in FIGS. 31 and 32.
Figure 34:
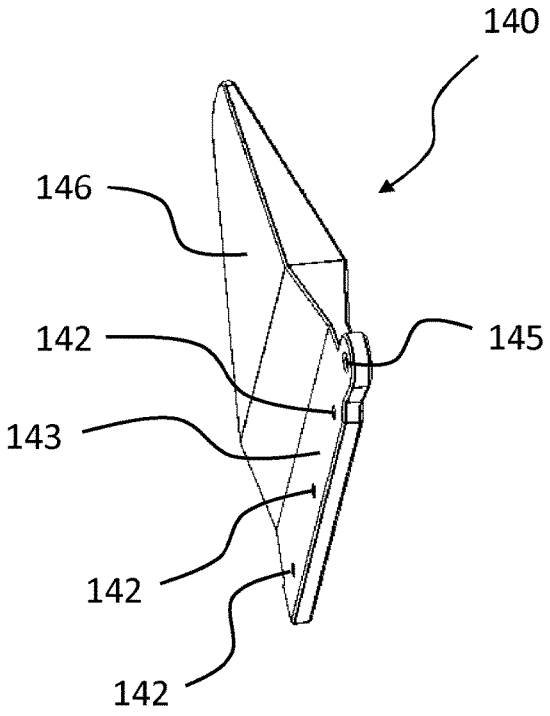
FIG. 34 is a second perspective view of the spacer shown in FIG. 33.
Figure 35:
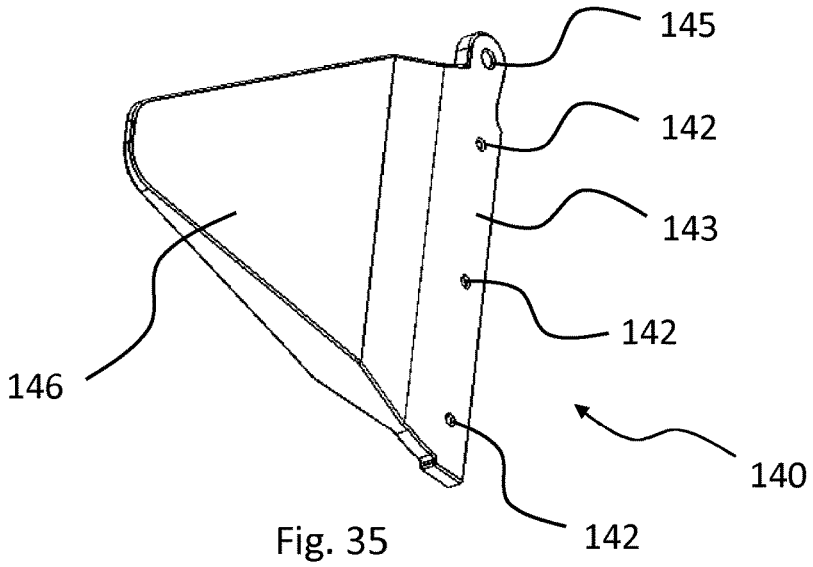
FIG. 35 is a third perspective view of the spacer shown in FIGS. 33 and 34.

FIGS. 33 to 35 are three different views of a spacer 140 in the perimeter protection system 104 shown in FIGS. 31 and 32. The spacer 140 comprises a first side 141 and an opposing second side 143, both of which can be positioned abutting a respective one of the sides 116 of either one of the security bulwarks 119 and 130. As can be seen, the profile of the sides 141, 143 mirrors that of the sides 116 of both of the security bulwarks 119, 130. The spacer 140 also comprises a plurality of through-holes 142 from the first side 141 to the opposing second side 143 of the spacer 140. The locations of the through-holes 142 on the spacer 140 correspond to the locations of the connection sites 117 on the sides 116 of the security bulwarks 119, 130. Thus if a pair of such security bulwarks 119 and/or 130 are arranged side-by-side adjacent to each other with one of the spacers 140 positioned between them, the through-holes 142 on the spacers 140 can be aligned with the connection sites 117 on the sides 116 of the security bulwarks 119, 130. The adjacent pair of security bulwarks 119, 130 can then be connected to each other via the respective through-holes 142 of the spacer 140 positioned between them. For example, a connector, such as a bolt, can be inserted into a through-hole in the side 116 of a first one of the pair of security bulwarks 119 or 130, through the respective through-hole 142 of the spacer 140 and out of a through-hole in the side 116 of the other one of the pair of security bulwarks 119 or 130, in a direction parallel with a perimeter railing to which the perimeter protection system 104 is mounted. The bolt can then be fitted with a nut, for example, and both can be tightened together until the adjacent pair of security bulwarks 119, 130 and the spacer 140 positioned between them abut each other. This allows for quick and easy connection of the adjacent pair of the security bulwarks 119, 130 to each other via the spacer 140 positioned between them, to form a strong and structurally sound security barrier comprising the adjacent pair of security bulwarks 119, 130 and the spacer 140.

As may also be seen in FIGS. 33 to 35, the spacer 140 differs from the spacer 40 shown in FIGS. 29 and 30 in that the spacer 140 further comprises a nose 146. When the spacer 140 is positioned between an adjacent pair of security bulwarks 119 and/or 130 in a perimeter protection system, the nose 146 projects outwardly in a seaward direction between the adjacent side surfaces 5*g*, 5*h* of the mounds 133 on respective ones of the adjacent pair of security bulwarks 119, 130, as may best be seen in FIG. 30. This provides an additional obstruction to thwart unauthorized potential boarders from trying to squeeze between the adjacent pair of security bulwarks 119, 130.

The invention claimed is:

1. A security bulwark for mounting outside a perimeter railing of a vessel or marine installation, the security bulwark having a front face comprising a projecting mound, wherein the projecting mound has an underside providing the security bulwark with an overhang and the projecting mound is curved and convex shaped in both a horizontal direction and a vertical direction of the security bulwark, wherein the projecting mound is configured to extend from the perimeter railing and is convex shaped more than halfway back to the perimeter railing.

2. A security bulwark according to claim 1, wherein the projecting mound has a side surface angled at between 60 and 82 degrees to the front face of the security bulwark.

3. A security bulwark according to claim 1, wherein the projecting mound is not more than 300 mm wide at its furthest projection from the front face of the security bulwark.

4. A security bulwark according to claim 1, wherein the projecting mound rises from the front face of the security bulwark not more than 150 mm from a side edge of the security bulwark.

5. A security bulwark according to claim 1, wherein the front face of the security bulwark comprises a pair of projecting mounds divided by a valley, a deepest part of which is not more than 300 mm wide between the pair of projecting mounds.

6. A security bulwark according to claim 5, the security bulwark having an eyelet formed through the front face of the security bulwark, wherein the eyelet is substantially aligned with the deepest part of the valley.

7. A security bulwark according to claim 1, further comprising a left side face and a right side face oriented substantially perpendicular to each other, wherein at least one of the left side face and the right side face comprises a connection site for connecting the security bulwark to an adjacent security bulwark.

8. A security bulwark according claim 1, wherein the security bulwark has a back comprising a recess able to receive the projecting mound on the front face of a similar security bulwark, whereby the security bulwarks can be nested together.

9. A security bulwark according to claim 1, wherein the recess is formed by an interior surface of the projecting mound and the projecting mound further comprises a raised crest adapting the recess to receive a corner of the perimeter railing.

10. A security bulwark according to claim 1, further comprising a borehole running in the direction of the breadth of the security bulwark and alongside an uppermost edge of the security bulwark.

11. A security bulwark according to claim 10, further comprising a rear panel for mounting inside the perimeter railing, wherein the rear panel is hinged relative to the front face of the security bulwark substantially parallel to the uppermost edge of the security bulwark.

12. A security bulwark according to claim 11, further comprising a rod disposed in the borehole and wherein the rear panel is hinged relative to the front face of the security bulwark by rotation about the rod, the rod being removable from the borehole, whereby the rear panel is detachable from a rest of the security bulwark.

13. A perimeter protection system comprising a plurality of security bulwarks, wherein the plurality of security bulwarks comprises a first security bulwark for mounting outside a perimeter railing of a vessel or marine installation, the first security bulwark having a front face comprising a projecting mound, wherein the projecting mound has an underside providing the first security bulwark with an overhang and the projecting mound is curved and convex shaped in both a horizontal direction and a vertical direction of the first security bulwark, wherein the projecting mound is configured to extend from the perimeter railing and is convex shaped more than halfway back to the perimeter railing, and wherein the plurality of security bulwarks are arranged side-by-side and adjacent to each other.

14. A perimeter protection system according to claim 13, wherein the perimeter protection system comprises three adjacent security bulwarks and a rod passing through a borehole of a central one of the three adjacent security bulwarks and into at least one of respective boreholes of a leftmost one and a rightmost one of the three adjacent security bulwarks.

15. A perimeter protection system according to claim 13, further comprising a spacer positioned between and abutting each of an adjacent pair of the plurality of security bulwarks, wherein the spacer comprises a through-hole for connecting the adjacent pair of the plurality of security bulwarks to each other.

16. A perimeter protection system according to claim 13 arranged along the perimeter railing of the vessel or marine installation.

17. A perimeter protection system according to claim 16, further comprising cargo protected by the perimeter protection system.

18. A method of protecting a perimeter of a vessel or marine installation, the method comprising:

positioning a plurality of security bulwarks side-by-side and adjacent to each other along a perimeter railing of the vessel or marine installation, wherein the plurality of security bulwarks comprises a first security bulwark for mounting outside the perimeter railing of the vessel or marine installation, the first security bulwark having a front face comprising a projecting mound, wherein the projecting mound has an underside providing the first security bulwark with an overhang and the projecting mound is convex in a horizontal direction of a breadth of the first security bulwark;

attaching some of the plurality of security bulwarks to the perimeter railing; and connecting remaining ones of the plurality of security bulwarks which are not attached to the perimeter railing to ones of the plurality of security bulwarks which are attached to the perimeter railing.

19. A method according to claim 18, further comprising positioning at least one of the plurality of security bulwarks which are not attached to the perimeter railing in front of a gap in the perimeter railing or an obstruction in a way of the perimeter railing or at a corner of the perimeter railing.

20. A method according to claim 18, further comprising positioning a spacer between and abutting each of an adjacent pair of the plurality of security bulwarks, wherein the spacer comprises a through-hole for connecting the adjacent pair of the plurality of security bulwarks to each other.

* * * * *